US010720697B2

(12) United States Patent
Wen et al.

(10) Patent No.: US 10,720,697 B2
(45) Date of Patent: Jul. 21, 2020

(54) ANTENNA MODULE, MIMO ANTENNA, AND TERMINAL

(71) Applicant: HUAWEI TECHNOLOGIES CO., LTD., Shenzhen, Guangdong (CN)

(72) Inventors: Geyi Wen, Nanjing (CN); Jun Wang, Hangzhou (CN); Ming Zhang, Hangzhou (CN); Xueliang Shi, Hangzhou (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 82 days.

(21) Appl. No.: 16/018,664

(22) Filed: Jun. 26, 2018

(65) Prior Publication Data

US 2018/0309193 A1 Oct. 25, 2018

Related U.S. Application Data

(63) Continuation of application No. PCT/CN2016/106980, filed on Nov. 23, 2016.

(30) Foreign Application Priority Data

Dec. 29, 2015 (CN) ..... 2015 1 1020439

(51) Int. Cl.
*H01Q 1/48* (2006.01)
*H01Q 1/24* (2006.01)
(Continued)

(52) U.S. Cl.
CPC ..... *H01Q 1/246* (2013.01); *H01Q 1/243* (2013.01); *H01Q 1/48* (2013.01); *H01Q 5/371* (2015.01);
(Continued)

(58) Field of Classification Search
CPC ..... H01Q 1/246; H01Q 5/371; H01Q 1/243; H01Q 1/48; H01Q 9/42; H01Q 21/061; H01Q 21/28; H01Q 21/30
See application file for complete search history.

(56) References Cited

U.S. PATENT DOCUMENTS

2010/0127938 A1 5/2010 Ali et al.
2010/0271272 A1 10/2010 Sung et al.
(Continued)

FOREIGN PATENT DOCUMENTS

CA 2914269 A1 12/2014
CN 102224638 A 10/2011
(Continued)

OTHER PUBLICATIONS

Muhammad U. Khan et al.,"A Compact 8-Element MIMO Antenna System for 802.11ac WLAN Applications",2013 International Workshop on Antenna Technology (iWAT),total 4 pages.
(Continued)

*Primary Examiner* — Graham P Smith
(74) *Attorney, Agent, or Firm* — Fish & Richardson P.C.

(57) ABSTRACT

This application describes examples of antenna modules, MIMO antennas, and terminals. One example antenna module includes a clearance area, a support, and at least two branches. Each branch is disposed on the support, and a partial projection of the support on a horizontal plane falls within the clearance area, while a projection on the horizontal plane of one end that is of each branch and that is configured to connect to a feed point is outside the clearance area. A projection of a tail end on the horizontal plane is inside the clearance area.

15 Claims, 18 Drawing Sheets

(51) Int. Cl.

| | |
|---|---|
| ***H01Q 21/28*** | (2006.01) |
| ***H01Q 9/42*** | (2006.01) |
| ***H01Q 21/30*** | (2006.01) |
| ***H01Q 5/371*** | (2015.01) |
| ***H01Q 5/378*** | (2015.01) |
| ***H01Q 21/06*** | (2006.01) |

(52) U.S. Cl.

CPC ..... *H01Q 5/378* (2015.01); *H01Q 9/42* (2013.01); *H01Q 21/061* (2013.01); *H01Q 21/28* (2013.01); *H01Q 21/30* (2013.01)

(56) References Cited

U.S. PATENT DOCUMENTS

| | | | | |
|---|---|---|---|---|
| 2011/0043408 | A1 | 2/2011 | Shi et al. | |
| 2011/0115677 | A1 | 5/2011 | Rao et al. | |
| 2012/0127038 | A1* | 5/2012 | Kim ..... | H01Q 1/243 343/700 MS |
| 2016/0254596 | A1 | 9/2016 | Ai et al. | |

FOREIGN PATENT DOCUMENTS

| | | | |
|---|---|---|---|
| CN | 102394348 | A | 3/2012 |
| CN | 102544705 | A | 7/2012 |
| CN | 203386895 | U | 1/2014 |
| CN | 104300211 | A | 1/2015 |
| GB | 2449910 | A | 12/2008 |
| JP | 2013502856 | A | 1/2013 |
| JP | 2015173325 | A | 10/2015 |
| WO | 2011087135 | A1 | 7/2011 |

OTHER PUBLICATIONS

International Search Report and Written Opinion issued in International Application No. PCT/CN2016/106980 dated Feb. 16, 2017, 11 pages.

Extended European Search Report issued in European Application No. 16880820.2 dated Nov. 27, 2018, 9 pages.

Office Action issued in Japanese Application No. 2018-531569 dated Jul. 2, 2019, 8 pages (with English translation).

Office Action issued in Japanese Application No. 2018-531569 dated Feb. 18, 2020, 6 pages (with English translation).

* cited by examiner

ANTENNA MODULE, MIMO ANTENNA, AND TERMINAL

CROSS-REFERENCE TO RELATED APPLICATIONS

This application is a continuation of International Application No. PCT/CN2016/106980, filed on Nov. 23, 2016, which claims priority to Chinese Patent Application No. 201511020439.1, filed on Dec. 29, 2015. The disclosures of the aforementioned applications are hereby incorporated by reference in their entireties.

TECHNICAL FIELD

This application relates to the field of communications technologies, and in particular, to an antenna module, a multiple-input multiple-output (MIMO, Multiple-Input Multiple-Output) antenna, and a terminal.

BACKGROUND

At present, due to a limitation of a Shannon capacity, a conventional single-input single-output (SISO, single input single output) antenna system cannot meet requirements for a large capacity, a high rate, and high reliability of a new generation wireless communications system. In view of the objective fact that spectrum resources are limited, how to achieve higher spectrum utilization has become a problem that urgently needs to be resolved in development of new technologies in the current wireless communications field. In a multiple-input multiple-output (MIMO, Multiple-Input Multiple-Output) antenna system, a communications link can be effectively divided into a plurality of parallel sub-channels, thereby greatly improving a channel capacity, removing a limitation of the Shannon theorem, and greatly improving reliability.

However, when a multiple-input multiple-output (MIMO, Multiple-Input Multiple-Output) antenna system is applied to a base station, because available space of the base station is relatively large, a multiple-antenna technology can be easily applied. For terminal devices that are increasingly miniaturized, a plurality of antennas need to be centralized in small space, and to achieve good performance, the antenna modules need to be well isolated, and a low correlation coefficient is required for the antenna modules. In addition, at present, on a worldwide basis, there are a plurality of standards to meet different applications, and these standards cover different bands. Therefore, an antenna system needs to be capable of operating in a plurality of bands. Space in a handheld device (such as a mobile phone) is very limited, and a distance between antenna modules forming an MIMO antenna is very short. Consequently, it is very difficult to design a MIMO antenna system that meets these requirements and has good performance.

SUMMARY

A main objective of this application is to provide an antenna module, a MIMO antenna, and a terminal. The antenna module can operate in a plurality of bands, and miniaturization of the antenna module can be implemented. When the antenna module is applied to the MIMO antenna, a size of the MIMO antenna can be reduced. When the MIMO antenna is applied to the terminal, a design requirement for miniaturization of the terminal can be met.

To achieve the foregoing objective, the following technical solutions are used in this application.

According to a first aspect, an embodiment of this application provides an antenna module. The antenna module includes a clearance area, a support, and at least two branches; and each branch is disposed on the support; a partial projection of the support on a horizontal plane falls within the clearance area; and a projection, on the horizontal plane, of one end that is of each branch and that is configured to connect to a feed point is outside the clearance area, and a projection of a tail end on the horizontal plane is inside the clearance area, where when each branch is a feed branch, one end of the feed branch is connected to the feed point, one end is grounded, and one end is open-circuited; the end that is open-circuited is referred to as the tail end, and the tail end is disposed inside the clearance area, to complete resonance, so that surface currents on the branch are centralized on an edge of the clearance area as many as possible, and currents distributed on a ground plate are reduced.

The end that is of each of the at least two branches and that is configured to connect to the feed point is disposed outside the clearance area, and the tail end is disposed inside the clearance area, so that space of the clearance area can be properly used, and a size of the clearance area can be reduced, thereby implementing miniaturization of the antenna module. In addition, the at least two branches can resonate in different bands, so that the antenna module can operate in a plurality of bands.

With reference to the first aspect, in a first possible implementation of the first aspect, the clearance area includes a first side edge and a second side edge that are adjacent to each other, and a third side edge and a fourth side edge that are disposed respectively opposite to the first side edge and the second side edge; and the support includes a first side surface and a second side surface that are adjacent to each other, and a third side surface and a fourth side surface that are respectively opposite to the first side surface and the second side surface; and a projection of the second side surface of the support on the horizontal plane falls on a straight line of the second side edge of the clearance area, and coincides with at least a part of the second side edge of the clearance area; a distance between a projection of the support on the horizontal plane and each of the third side edge and the fourth side edge of the clearance area is any value within a range of 0 mm to 5 mm; and the first side surface of the support is outside the clearance area.

The clearance area and the support are arranged in the foregoing location relationship, so that the size of the clearance area can be reduced to the greatest extent, thereby reducing a size of the antenna module to the greatest extent. In addition, that a distance between a projection of the support on the horizontal plane and each of the third side edge and the fourth side edge of the clearance area is 0 mm to 5 mm means that: a distance between a projection, on the horizontal plane, of the third side surface of the support that is projected on the horizontal plane and the third side edge of the clearance area and a distance between a projection, on the horizontal plane, of the fourth side surface of the support that is projected on the horizontal plane and the fourth side edge of the clearance area are any values within the range of 0 mm to 5 mm. A longer distance indicates that the surface currents on the branch can be more effectively centralized on the edge of the clearance area, and a shorter distance indicates that the size of the clearance area can be more effectively reduced.

With reference to the first possible implementation of the first aspect, in a second possible implementation of the first aspect, the at least two branches include a first feed branch and a second feed branch, and the antenna module further includes the feed point and a ground point;

one end that is of the first feed branch and that is configured to connect to the feed point is disposed on the first side surface of the support, and extends to the second side surface of the support along the first side surface of the support; and the ground point is connected to the first feed branch on the first side surface of the support;

one end that is of the second feed branch and that is configured to connect to the feed point is connected to the first feed branch on the first side surface of the support, and extends to an upper surface of the support along the first side surface of the support; and a length of the first feed branch is ¼ of a wavelength corresponding to a first preset band, and a length of the second feed branch is ⅛ of a wavelength corresponding to a second preset band.

The two feed branches are disposed on the support, and locations and the lengths of the two feed branches are adjusted, so that the antenna module operates in the first preset band and the second preset band. In addition, because of relative location relationships between the two feed branches and the clearance area, the surface currents on the two feed branches are centralized on the edge of the clearance area, and the currents distributed on the ground plate can be reduced, thereby reducing current coupling between antenna modules.

With reference to the second possible implementation of the first aspect, in a third possible implementation of the first aspect, the at least two branches further include a parasitic branch;

the parasitic branch is disposed inside the clearance area, and one end of the parasitic branch is connected to the first side edge of the clearance area; and a length of the parasitic branch is 1/10 of a wavelength corresponding to a third preset band.

The parasitic branch is added, and a location and the length of the parasitic branch are adjusted, so that the parasitic branch resonates in the third preset band, and the antenna module operates in three bands, thereby improving performance of the antenna module. In addition, because of corresponding location relationships between the three branches and the clearance area, when the antenna module is applied to a MIMO antenna, the surface currents on each feed branch are centralized on the edge of the clearance area, and the currents distributed on the ground plate can be reduced, thereby reducing current coupling between the antenna modules.

With reference to the first aspect, in a fourth possible implementation of the first aspect, the clearance area includes a first area and a second area that are orthogonal to each other; the first area includes a side edge-I and a side edge-II that are adjacent to each other, and a side edge-III and a side edge-IV that are disposed respectively opposite to the side edge-I and the side edge-II; the second area is a structure that extends out along a length direction of the side edge-II of the first area; and the support includes a first side surface and a second side surface that are adjacent to each other, and a third side surface and a fourth side surface that are respectively opposite to the first side surface and the second side surface; and a projection of the third side surface of the support on the horizontal plane coincides with the side edge-I of the first area; a projection of the second side surface of the support on the horizontal plane falls on a straight line of the side edge-IV of the first area, and coincides with a part of the side edge-IV of the first area; a distance between a projection of the support on the horizontal plane and each of the side edge-II of the first area and a side edge that is of the second area and that is far away from the first area is any value within a range of 0 mm to 5 mm; and a partial projection of the first side surface of the support on the horizontal plane is outside the clearance area.

The clearance area and the support are arranged in the foregoing location relationship, so that the size of the clearance area can be reduced to the greatest extent, thereby reducing a size of the antenna module to the greatest extent. In addition, that a distance between the fourth side surface that is of the support and that is projected on the horizontal plane and the side edge-II of the first area is any value within the range of 0 mm to 5 mm means that distances between some areas on the first side surface of the support and the side edge that is of the second area and that is far away from the first area are any values within the range of 0 mm to 5 mm. A longer distance indicates that the surface currents on the branch can be more effectively centralized on the edge of the clearance area, and a shorter distance indicates that the size of the clearance area can be more effectively reduced.

With reference to the fourth possible implementation of the first aspect, in a fifth possible implementation of the first aspect, the at least two branches include a feed branch-I and a feed branch-II, and the antenna module further includes the feed point and a ground point;

one end that is of the feed branch-I and that is configured to connect to the feed point is connected to the feed point; a first end of the feed branch-I is disposed on the first side surface of the support, and extends to the second side surface of the support along the first side surface of the support; and the ground point is disposed on the feed branch-I on the second side surface of the support;

one end that is of the feed branch-II and that is configured to connect to the feed point is connected to the feed branch-I on the first side surface of the support, and extends to an upper surface of the support along the first side surface of the support; and a length of the feed branch-I is ¼ of a wavelength corresponding to a first preset band, and a length of the feed branch-II is ⅛ of a wavelength corresponding to a second preset band.

The two feed branches are disposed on the support, and locations and the lengths of the two feed branches are adjusted, so that the antenna module operates in the first preset band and the second preset band. In addition, because of relative location relationships between the two feed branches and the clearance area, the surface currents on the two feed branches are centralized on the edge of the clearance area, and the currents distributed on the ground plate can be reduced, thereby reducing current coupling between antenna modules.

With reference to the fifth possible implementation of the first aspect, in a sixth possible implementation of the first aspect, the at least two branches further include a feed branch-III;

one end that is of the feed branch-III and that is configured to connect to the feed point is connected to the feed branch-II on the first side surface of the support, and extends to the fourth side surface of the support along the first side surface of the support; and a length of the feed branch-III is 1/10 of a wavelength corresponding to a third preset band.

The feed branch-III is added, and a location and the length of the feed branch-III are adjusted, so that the feed branch-III resonates in the third preset band, and the antenna module operates in three bands, thereby improving performance of the antenna module. In addition, because of corresponding location relationships between the three feed branches and the clearance area, when the antenna module is applied to a MIMO antenna, the surface currents on each feed branch are centralized on the edge of the clearance area, and the currents distributed on the ground plate can be reduced, thereby reducing current coupling between the antenna modules.

According to a second aspect, this application provides a MIMO antenna, including a ground plate, and at least two antenna modules disposed on the ground plate, where each antenna module includes a clearance area, a support, and at least two branches;

each branch is disposed on the support; a partial projection of the support on a horizontal plane falls within the clearance area; and a projection, on the horizontal plane, of one end that is of each branch and that is configured to connect to a feed point is outside the clearance area, and a projection of a tail end on the horizontal plane is inside the clearance area, where when each branch is a feed branch, one end of the feed branch is connected to the feed point, one end is grounded, and one end is open-circuited; the end that is open-circuited is referred to as the tail end, and the tail end is disposed inside the clearance area, to complete resonance, so that surface currents on the branch are centralized on an edge of the clearance area as many as possible, and currents distributed on a ground plate are reduced.

The end that is of each of the at least two branches and that is configured to connect to the feed point is disposed outside the clearance area, and the tail end is disposed inside the clearance area, so that space of the clearance area can be properly used, and a size of the clearance area can be reduced, thereby implementing miniaturization of the antenna module. In addition, the at least two branches can resonate in different bands, so that the antenna module can operate in a plurality of bands.

With reference to the second aspect, in a first possible implementation of the second aspect, the clearance area includes a first side edge and a second side edge that are adjacent to each other, and a third side edge and a fourth side edge that are disposed respectively opposite to the first side edge and the second side edge; and the support includes a first side surface and a second side surface that are adjacent to each other, and a third side surface and a fourth side surface that are respectively opposite to the first side surface and the second side surface; and a projection of the second side surface of the support on the horizontal plane falls on a straight line of the second side edge of the clearance area, and coincides with at least a part of the second side edge of the clearance area; a distance between a projection of the support on the horizontal plane and each of the third side edge and the fourth side edge of the clearance area is any value within a range of 0 mm to 5 mm; and the first side surface of the support is outside the clearance area.

The clearance area and the support are arranged in the foregoing location relationship, so that the size of the clearance area can be reduced to the greatest extent, thereby reducing a size of the antenna module to the greatest extent. In addition, that a distance between a projection of the support on the horizontal plane and each of the third side edge and the fourth side edge of the clearance area is 0 mm to 5 mm means that: a distance between a projection, on the horizontal plane, of the third side surface of the support that is projected on the horizontal plane and the third side edge of the clearance area and a distance between a projection, on the horizontal plane, of the fourth side surface of the support that is projected on the horizontal plane and the fourth side edge of the clearance area are any values within the range of 0 mm to 5 mm. A longer distance indicates that the surface currents on the branch can be more effectively centralized on the edge of the clearance area, and a shorter distance indicates that the size of the clearance area can be more effectively reduced.

With reference to the first possible implementation of the second aspect, in a second possible implementation of the second aspect, the at least two branches include a first feed branch and a second feed branch, and the antenna module further includes the feed point and a ground point;

one end that is of the first feed branch and that is configured to connect to the feed point is disposed on the first side surface of the support, and extends to the second side surface of the support along the first side surface of the support; and the ground point is connected to the first feed branch on the first side surface of the support;

one end that is of the second feed branch and that is configured to connect to the feed point is connected to the first feed branch on the first side surface of the support, and extends to an upper surface of the support along the first side surface of the support; and a length of the first feed branch is 1/4 of a wavelength corresponding to a first preset band, and a length of the second feed branch is 1/8 of a wavelength corresponding to a second preset band.

The two feed branches are disposed on the support, and locations and the lengths of the two feed branches are adjusted, so that the antenna module operates in the first preset band and the second preset band. In addition, because of relative location relationships between the two feed branches and the clearance area, the surface currents on the two feed branches are centralized on the edge of the clearance area, and the currents distributed on the ground plate can be reduced, thereby reducing current coupling between antenna modules.

With reference to the second possible implementation of the second aspect, in a third possible implementation of the second aspect, the at least two branches further include a parasitic branch;

the parasitic branch is disposed inside the clearance area, and one end of the parasitic branch is connected to the first side edge of the clearance area; and a length of the parasitic branch is 1/10 of a wavelength corresponding to a third preset band.

The parasitic branch is added, and a location and the length of the parasitic branch are adjusted, so that the parasitic branch resonates in the third preset band, and the antenna module operates in three bands, thereby improving performance of the antenna module. In addition, because of corresponding location relationships between the three branches and the clearance area, when the antenna module is applied to a MIMO antenna, the surface currents on each feed branch are centralized on the edge of the clearance area, and the currents distributed on the ground plate can be reduced, thereby reducing current coupling between the antenna modules.

With reference to the third implementation of the second aspect, in a fourth implementation of the second aspect, the at least two antenna modules include a first antenna module and a second antenna module, and the first antenna module and the second antenna module are any two adjacent antenna modules; and if the first antenna module and the second antenna module have a same structure, the first antenna module and the second antenna module are sequentially arranged in a staggered manner in a first direction and a second direction, a second side surface of the first antenna module faces a third direction opposite to the first direction, and a second side surface of the second antenna module faces the second direction, a distance between feed points of the two adjacent antenna modules is greater than or equal to ¼ of a wavelength corresponding to a lowest band covered by the antenna module;

if the first antenna module and the second antenna module are mirror symmetric, the first antenna module and the second antenna module are sequentially arranged in a staggered manner in a first direction and a second direction, a second side surface of the first antenna module faces a third direction opposite to the first direction, and a second side surface of the second antenna module faces the second direction, a distance between feed points of the two adjacent antenna modules is greater than or equal to ¼ of a wavelength corresponding to a lowest band covered by the antenna module;

if the first antenna module and the second antenna module are mirror symmetric and have reverse feed directions, a distance between feed points of the two adjacent antenna modules is greater than or equal to ⅛ of a wavelength corresponding to a lowest band covered by the antenna module;

if the first antenna module and the second antenna module are mirror symmetric and have opposite feed directions, a distance between feed points of the two adjacent antenna modules is greater than or equal to ¼ of a wavelength corresponding to a lowest band covered by the antenna module; or if the first antenna module and the second antenna module are mirror symmetric and have a same feed direction, and fourth side surfaces of the two adjacent antenna modules are disposed opposite to each other, a distance between feed points of the two adjacent antenna modules is greater than or equal to ¼ of a wavelength corresponding to a lowest band covered by the antenna module.

The any two adjacent antenna modules are arranged in the foregoing manner, so that a distance between the antenna modules can be reduced, thereby further reducing a size of the MIMO antenna, and ensuring multi-band performance and high isolation performance of the MIMO antenna.

With reference to the fourth possible implementation of the second aspect, in a fifth possible implementation of the second aspect, there are two to eight antenna modules.

With reference to the fifth possible implementation of the second aspect, in a sixth possible implementation of the second aspect, when there are eight antenna modules, the eight antenna modules are sequentially arranged to enclose a first enclosed area, and a second side surface of each antenna module faces the exterior of the first enclosed area. The eight-unit MIMO antenna is arranged in such a manner, so that the size of the eight-unit MIMO antenna can be reduced to the greatest extent, thereby improving compactness of the eight-unit MIMO antenna.

With reference to the second aspect, in a seventh possible implementation of the second aspect, the clearance area includes a first area and a second area that are orthogonal to each other; the first area includes a side edge-I and a side edge-II that are adjacent to each other, and a side edge-III and a side edge-IV that are disposed respectively opposite to the side edge-I and the side edge-II; the second area is a structure that extends out along a length direction of the side edge-II of the first area; and the support includes a first side surface and a second side surface that are adjacent to each other, and a third side surface and a fourth side surface that are respectively opposite to the first side surface and the second side surface; and a projection of the third side surface of the support on the horizontal plane coincides with the side edge-I of the first area; a projection of the second side surface of the support on the horizontal plane falls on a straight line of the side edge-IV of the first area, and coincides with a part of the side edge-IV of the first area; a distance between a projection of the support on the horizontal plane and each of the side edge-II of the first area and a side edge that is of the second area and that is far away from the first area is any value within a range of 0 mm to 5 mm; and a partial projection of the first side surface of the support on the horizontal plane is outside the clearance area.

The clearance area and the support are arranged in the foregoing location relationship, so that the size of the clearance area can be reduced to the greatest extent, thereby reducing a size of the antenna module to the greatest extent. In addition, that a distance between the fourth side surface that is of the support and that is projected on the horizontal plane and the side edge-II of the first area is any value within the range of 0 mm to 5 mm means that distances between some areas on the first side surface of the support and the side edge that is of the second area and that is far away from the first area are any values within the range of 0 mm to 5 mm. A longer distance indicates that the surface currents on the branch can be more effectively centralized on the edge of the clearance area, and a shorter distance indicates that the size of the clearance area can be more effectively reduced.

With reference to the seventh possible implementation of the second aspect, in an eighth possible implementation of the second aspect, the at least two branches include a feed branch-I and a feed branch-II, and the antenna module further includes the feed point and a ground point;

one end that is of the feed branch-I and that is configured to connect to the feed point is connected to the feed point; a first end of the feed branch-I is disposed on the first side surface of the support, and extends to the second side surface of the support along the first side surface of the support; and the ground point is disposed on the feed branch-I on the second side surface of the support;

one end that is of the feed branch-II and that is configured to connect to the feed point is connected to the feed branch-I on the first side surface of the support, and extends to an upper surface of the support along the first side surface of the support; and a length of the feed branch-I is ¼ of a wavelength corresponding to a first preset band, and a length of the feed branch-II is ⅛ of a wavelength corresponding to a second preset band.

The two feed branches are disposed on the support, and locations and the lengths of the two feed branches are adjusted, so that the antenna module operates in the first preset band and the second preset band. In addition, because of relative location relationships between the two feed branches and the clearance area, the surface currents on the two feed branches are centralized on the edge of the clearance area, and the currents distributed on the ground plate can be reduced, thereby reducing current coupling between antenna modules.

With reference to the eighth possible implementation of the second aspect, in a ninth possible implementation of the second aspect, the at least two branches further include a feed branch-III;

one end that is of the feed branch-III and that is configured to connect to the feed point is connected to the feed branch-II on the first side surface of the support, and extends to the fourth side surface of the support along the first side surface of the support; and a length of the feed branch-III is 1/10 of a wavelength corresponding to a third preset band.

The feed branch-III is added, and a location and the length of the feed branch-III are adjusted, so that the feed branch-III resonates in the third preset band, and the antenna module operates in three bands, thereby improving performance of the antenna module. In addition, because of corresponding location relationships between the three feed branches and the clearance area, when the antenna module is applied to a MIMO antenna, the surface currents on each feed branch are centralized on the edge of the clearance area, and the currents distributed on the ground plate can be reduced, thereby reducing current coupling between the antenna modules.

With reference to the ninth possible implementation of the second aspect, in a tenth possible implementation of the second aspect, the at least two antenna modules include a third antenna module and a fourth antenna module, and the third antenna module and the fourth antenna module are any two adjacent antenna modules; and if the third antenna module and the fourth antenna module have a same structure and are disposed orthogonal to each other, the third antenna module and the fourth antenna module are sequentially arranged along a fourth direction opposite to a second direction, and a first side surface of the third antenna module is opposite to a fourth side surface of the fourth antenna module, a distance between feed points of the two adjacent antenna modules is greater than or equal to ⅛ of a wavelength corresponding to a lowest band covered by the antenna module;

if the third antenna module and the fourth antenna module have a same structure and are sequentially arranged along a first direction perpendicular to a fourth direction, and a fourth side surface of the third antenna module is opposite to a first side surface or a second side surface of the fourth antenna module, a distance between feed points of the two adjacent antenna modules is greater than or equal to ¼ of a wavelength corresponding to a lowest band covered by the antenna module;

if the third antenna module and the fourth antenna module have a same structure and have reverse feed directions and are sequentially arranged along a fourth direction, a distance between feed points of the two adjacent antenna modules is greater than or equal to ¼ of a wavelength corresponding to a lowest band covered by the antenna module;

if the third antenna module and the fourth antenna module are mirror symmetric, are disposed orthogonal to each other and are sequentially arranged along a fourth direction, and a second side surface of the third antenna module is opposite to a first side surface of the fourth antenna module, a distance between feed points of the two adjacent antenna modules is greater than or equal to ⅛ of a wavelength corresponding to a lowest band covered by the antenna module; or if the third antenna module and the fourth antenna module are mirror symmetric and are sequentially arranged along a first direction, and a fourth side surface of the third antenna module is opposite to a third side surface or a fourth side surface of the fourth antenna module, a distance between feed points of the two adjacent antenna modules is greater than or equal to ¼ of a wavelength corresponding to a lowest band covered by the antenna module.

The any two adjacent antenna modules are arranged in the foregoing manner, so that a distance between the antenna modules can be reduced, thereby further reducing a size of the MIMO antenna, and ensuring multi-band performance and high isolation performance of the MIMO antenna.

With reference to the tenth possible implementation of the second aspect, in an eleventh possible implementation of the second aspect, there are two to eight antenna modules.

With reference to the eleventh possible implementation of the second aspect, in a twelfth possible implementation of the second aspect, when there are eight antenna modules, the eight antenna modules are sequentially arranged to enclose a second enclosed area, and a second side surface or a third side surface of each antenna module faces the exterior of the second enclosed area. The eight-unit MIMO antenna is arranged in such a manner, so that the size of the eight-unit MIMO antenna can be reduced to the greatest extent, thereby improving compactness of the eight-unit MIMO antenna.

According to a third aspect, an embodiment of this application provides a terminal, including a MIMO antenna, and a radio frequency end disposed on a printed circuit board, where each feed point of the MIMO antenna is connected to the radio frequency end, and the radio frequency end is configured to send a signal to the MIMO antenna, or receive a signal sent by the MIMO antenna; and the MIMO antenna includes a ground plate, and at least two antenna modules disposed on the ground plate;

each antenna module includes a clearance area, a support, and at least two branches; and each branch is disposed on the support; a partial projection of the support on a horizontal plane falls within the clearance area; and a projection, on the horizontal plane, of one end that is of each branch and that is configured to connect to a feed point is outside the clearance area, and a projection of a tail end on the horizontal plane is inside the clearance area.

The antenna module of a relatively small size is applied to the MIMO antenna, so that a size of the MIMO antenna can be reduced. When the MIMO antenna is applied to the terminal, a size of the terminal can be reduced, and a requirement for miniaturization of the terminal can be met.

With reference to the third aspect, in a first possible implementation of the third aspect, the clearance area includes a first side edge and a second side edge that are adjacent to each other, and a third side edge and a fourth side edge that are disposed respectively opposite to the first side edge and the second side edge; and the support includes a first side surface and a second side surface that are adjacent to each other, and a third side surface and a fourth side surface that are respectively opposite to the first side surface and the second side surface; and a projection of the second side surface of the support on the horizontal plane falls on a straight line of the second side edge of the clearance area, and coincides with at least a part of the second side edge of the clearance area; a distance between a projection of the support on the horizontal plane and each of the third side edge and the fourth side edge of the clearance area is any value within a range of 0 mm to 5 mm; and the first side surface of the support is outside the clearance area.

The clearance area and the support are arranged in the foregoing location relationship, so that the size of the clearance area can be reduced to the greatest extent, thereby reducing a size of the antenna module to the greatest extent. In addition, that a distance between a projection of the support on the horizontal plane and each of the third side edge and the fourth side edge of the clearance area is 0 mm to 5 mm means that: a distance between a projection, on the horizontal plane, of the third side surface of the support that is projected on the horizontal plane and the third side edge of the clearance area and a distance between a projection, on the horizontal plane, of the fourth side surface of the support that is projected on the horizontal plane and the fourth side edge of the clearance area are any values within the range of 0 mm to 5 mm. A longer distance indicates that the surface currents on the branch can be more effectively centralized on the edge of the clearance area, and a shorter distance indicates that the size of the clearance area can be more effectively reduced.

With reference to the first possible implementation of the third aspect, in a second possible implementation of the third aspect, the at least two branches include a first feed branch and a second feed branch, and the antenna module further includes the feed point and a ground point;

one end that is of the first feed branch and that is configured to connect to the feed point is disposed on the first side surface of the support, and extends to the second side surface of the support along the first side surface of the support; and the ground point is connected to the first feed branch on the first side surface of the support;

one end that is of the second feed branch and that is configured to connect to the feed point is connected to the first feed branch on the first side surface of the support, and extends to an upper surface of the support along the first side surface of the support; and a length of the first feed branch is ¼ of a wavelength corresponding to a first preset band, and a length of the second feed branch is ⅛ of a wavelength corresponding to a second preset band.

The two feed branches are disposed on the support, and locations and the lengths of the two feed branches are adjusted, so that the antenna module operates in the first preset band and the second preset band. In addition, because of relative location relationships between the two feed branches and the clearance area, the surface currents on the two feed branches are centralized on the edge of the clearance area, and the currents distributed on the ground plate can be reduced, thereby reducing current coupling between antenna modules.

With reference to the second possible implementation of the third aspect, in a third possible implementation of the third aspect, the at least two branches further include a parasitic branch;

the parasitic branch is disposed inside the clearance area, and one end of the parasitic branch is connected to the first side edge of the clearance area; and a length of the parasitic branch is 1/10 of a wavelength corresponding to a third preset band.

The parasitic branch is added, and a location and the length of the parasitic branch are adjusted, so that the parasitic branch resonates in the third preset band, and the antenna module operates in three bands, thereby improving performance of the antenna module. In addition, because of corresponding location relationships between the three branches and the clearance area, when the antenna module is applied to a MIMO antenna, the surface currents on each feed branch are centralized on the edge of the clearance area, and the currents distributed on the ground plate can be reduced, thereby reducing current coupling between the antenna modules.

With reference to the third aspect, in a fourth possible implementation of the third aspect, the clearance area includes a first area and a second area that are orthogonal to each other; the first area includes a side edge-I and a side edge-II that are adjacent to each other, and a side edge-III and a side edge-IV that are disposed respectively opposite to the side edge-I and the side edge-II; the second area is a structure that extends out along a length direction of the side edge-II of the first area; and the support includes a first side surface and a second side surface that are adjacent to each other, and a third side surface and a fourth side surface that are respectively opposite to the first side surface and the second side surface; and a projection of the third side surface of the support on the horizontal plane coincides with the side edge-I of the first area; a projection of the second side surface of the support on the horizontal plane falls on a straight line of the side edge-IV of the first area, and coincides with a part of the side edge-IV of the first area; a distance between a projection of the support on the horizontal plane and each of the side edge-II of the first area and a side edge that is of the second area and that is far away from the first area is any value within a range of 0 mm to 5 mm; and a partial projection of the first side surface of the support on the horizontal plane is outside the clearance area.

The clearance area and the support are arranged in the foregoing location relationship, so that the size of the clearance area can be reduced to the greatest extent, thereby reducing a size of the antenna module to the greatest extent. In addition, that a distance between the fourth side surface that is of the support and that is projected on the horizontal plane and the side edge-II of the first area is any value within the range of 0 mm to 5 mm means that distances between some areas on the first side surface of the support and the side edge that is of the second area and that is far away from the first area are any values within the range of 0 mm to 5 mm. A longer distance indicates that the surface currents on the branch can be more effectively centralized on the edge of the clearance area, and a shorter distance indicates that the size of the clearance area can be more effectively reduced.

With reference to the fourth possible implementation of the third aspect, in a fifth possible implementation of the third aspect, the at least two branches include a feed branch-I and a feed branch-II, and the antenna module further includes the feed point and a ground point;

one end that is of the feed branch-I and that is configured to connect to the feed point is connected to the feed point; a first end of the feed branch-I is disposed on the first side surface of the support, and extends to the second side surface of the support along the first side surface of the support; and the ground point is disposed on the feed branch-I on the second side surface of the support;

one end that is of the feed branch-II and that is configured to connect to the feed point is connected to the feed branch-I on the first side surface of the support, and extends to an upper surface of the support along the first side surface of the support; and a length of the feed branch-I is ¼ of a wavelength corresponding to a first preset band, and a length of the feed branch-II is ⅛ of a wavelength corresponding to a second preset band.

The two feed branches are disposed on the support, and locations and the lengths of the two feed branches are adjusted, so that the antenna module operates in the first preset band and the second preset band. In addition, because of relative location relationships between the two feed branches and the clearance area, the surface currents on the two feed branches are centralized on the edge of the clearance area, and currents distributed on the ground plate can be reduced, thereby reducing current coupling between antenna modules.

With reference to the fifth possible implementation of the third aspect, in a sixth possible implementation of the third aspect, the at least two branches further include a feed branch-III;

one end that is of the feed branch-III and that is configured to connect to the feed point is connected to the feed branch-II on the first side surface of the support, and extends to the fourth side surface of the support along the first side surface of the support; and a length of the feed branch-III is 1/10 of a wavelength corresponding to a third preset band.

The feed branch-III is added, and a location and the length of the feed branch-III are adjusted, so that the feed branch-III resonates in the third preset band, and the antenna module operates in three bands, thereby improving performance of the antenna module. In addition, because of corresponding location relationships between the three feed branches and the clearance area, when the antenna module is applied to a MIMO antenna, the surface currents on each feed branch are centralized on the edge of the clearance area, and the currents distributed on the ground plate can be reduced, thereby reducing current coupling between the antenna modules.

The embodiments of this application provide the antenna module, the MIMO antenna, and the terminal. The at least two branches are disposed on the support, and the support is placed on the clearance area, so that the partial projection of the support on the horizontal plane is inside the clearance area, the projection, on the horizontal plane, of the end that is of each of the at least two branches and that is connected to the feed point is outside the clearance area, and the projection of the tail end on the horizontal plane is inside the clearance area. In this way, the space of the clearance area can be properly used, and the size of the clearance area can be reduced, thereby implementing miniaturization of the antenna module. Furthermore, the tail end of the branch is disposed inside the clearance area, to complete resonance, so that the surface currents on the branch are centralized on the edge of the clearance area as many as possible, and the currents distributed on the ground plate are reduced. In addition, the at least two branches can resonate in different bands, so that the antenna module can operate in a plurality of bands. Therefore, the antenna module can operate at a plurality of frequencies, and the size of the antenna module can be reduced, thereby implementing the miniaturization of the antenna module. When the antenna module is applied to the MIMO antenna, the size of the MIMO antenna can be reduced. When the MIMO antenna is applied to the terminal, the design requirement for miniaturization of the terminal can be met.

BRIEF DESCRIPTION OF DRAWINGS

To describe the technical solutions in the embodiments of this application or in the prior art more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DESCRIPTION OF EMBODIMENTS

The following clearly describes the technical solutions in the embodiments of this application with reference to the accompanying drawings in the embodiments of this application. Apparently, the described embodiments are merely some but not all of the embodiments of this application. All other embodiments obtained by a person of ordinary skill in the art based on the embodiments of this application without creative efforts shall fall within the protection scope of this application.

In descriptions of this application, it should be understood that, orientations or location relationships indicated by terms such as "center", "on", "below", "front", "back", "left", "right", "vertical", "horizontal", "top", "bottom", "inside", and "outside" are orientations or location relationships indicated based on the accompanying drawings, and are merely used for ease of describing this application and for ease of simplified descriptions, rather than for indicating or implying that an apparatus or an element must have a particular orientation or must be constructed or operated in a particular orientation, and therefore, cannot be construed as a limitation to this application. In the descriptions of this application, unless otherwise stated, "plurality of" means two or more than two.

Figure 1:
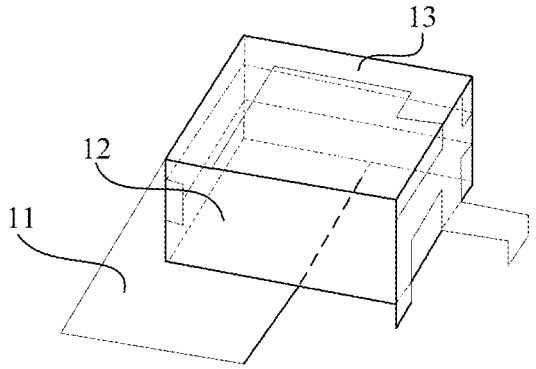
FIG. 1 is a schematic structural diagram of an antenna module according to an embodiment of this application.
Figure 2:
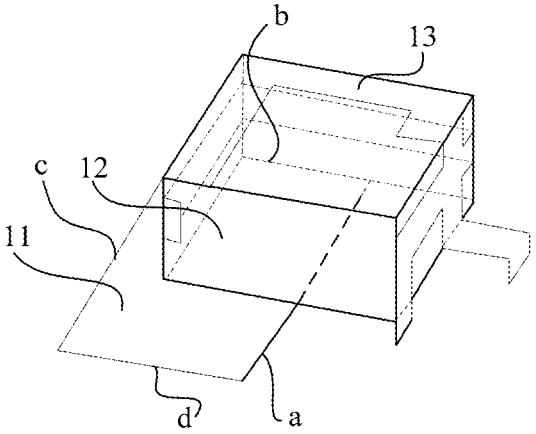
FIG. 2 is a schematic structural diagram of another antenna module according to an embodiment of this application.

A mobile terminal provided in the embodiments of the present invention may be configured to implement methods implemented in embodiments of the present invention shown in FIG. 1 and FIG. 2. For ease of description, only parts related to the embodiments of the present invention are shown, and for specific technical details that are not disclosed, refer to the embodiments of the present invention shown in FIG. 1 and FIG. 2.

An antenna module provided in this application may be applied to various mobile terminals. The mobile terminal may be a terminal device such as a mobile phone, a tablet computer, a notebook computer, a UMPC (Ultra-mobile Personal Computer, ultra-mobile personal computer), a netbook, or a PDA (Personal Digital Assistant, personal digital assistant). In the embodiments of this application, an example in which the mobile terminal is a mobile phone is used for description.

The antenna module provided in this application has a relatively small size. When the antenna module is applied to a MIMO antenna, a size of the MIMO antenna can be reduced, and because of a particular structure of the antenna module, when the antenna module is applied to the MIMO antenna, the antenna module can normally operate when a distance between antenna modules is reduced, which is represented as low coupling and high isolation, so that the size of the MIMO antenna can be further reduced, thereby meeting a requirement for a small size of a terminal such as a mobile phone. In addition, when the size of the terminal such as a mobile phone is fixed, a quantity of antenna modules can be increased. Therefore, communication performance of the terminal can be improved by using a feature that a throughput rate of the MIMO antenna is relatively high.

According to a first aspect, an embodiment of this application provides an antenna module. Referring to FIG. 1, the antenna module includes a clearance area 11, a support 12, and at least two branches 13.

Each branch 13 is disposed on the support 12. A partial projection of the support 12 on a horizontal plane falls within the clearance area 11. A projection, on the horizontal plane, of one end (not shown) that is of each branch 13 and that is configured to connect to a feed point is outside the clearance area 11, and a projection of a tail end (not shown) on the horizontal plane is inside the clearance area 11.

It should be noted that, during actual application, the branch 13 usually has more than two ends. For example, when the branch 13 is a feed branch, the feed branch usually includes one end connected to the feed point, one end connected to a ground point, and a free end that resonates. Therefore, in this embodiment of this application, the free end that resonates is referred to as the tail end.

This embodiment of this application provides the antenna module. The at least two branches 13 are disposed on the support 12, and the support 12 is placed on the clearance area 11, so that the partial projection of the support 12 on the horizontal plane is inside the clearance area 11, the projection, on the horizontal plane, of the end that is of each of the at least two branches 13 and that is connected to the feed point is outside the clearance area 11, and the projection of the tail end on the horizontal plane is inside the clearance area 11. In this way, the clearance area can be properly used, and a size of the clearance area can be reduced, thereby implementing miniaturization of the antenna module. Furthermore, the tail end of the branch 13 is disposed inside the clearance area 11, to complete resonance, so that surface currents on the branch 13 are centralized on an edge of the clearance area 11 as many as possible, and currents distributed on a ground plate are reduced. In addition, the at least two branches can resonate in different bands, so that the antenna module can operate in a plurality of bands. Therefore, the antenna module can operate at a plurality of frequencies, and a size of the antenna module can be reduced, thereby implementing the miniaturization of the antenna module. When the antenna module is applied to a MIMO antenna, a size of the MIMO antenna can be reduced.

It should be further noted that, the interior of the clearance area 11 includes the clearance area 11 and the edge of the clearance area 11. For example, when the clearance area 11 is a rectangle, if the projection of the tail end of each branch 13 on the horizontal plane is on an edge of the rectangle, it is considered that the projection of the tail end of each branch 13 on the horizontal plane is inside the clearance area 11. This is only an example for description herein.

A shape of the clearance area 11 is not limited. The clearance area 11 may have a regular shape such as a rectangle, a circle, or a triangle, or an irregular shape such as a polygon.

A shape of the support 12 is not limited either. The support 12 may also have a regular shape or an irregular shape.

The partial projection of the support 12 on the horizontal plane falls within the clearance area 11, and the projection of the free end of the branch 13 on the support 12 on the horizontal plane is inside the clearance area 11. Therefore, the shape of the clearance area 11 is related to both the shape of the support 12 and a location of the branch 13 on the support 12.

It should be noted that, to describe a relative location relationship between the support 12 and the clearance area 11, only an example in which the support 12 has a hexahedron structure is used for description.

In an embodiment of this application, referring to FIG. 2, the clearance area 11 includes a first side edge a and a second side edge b that are adjacent to each other, and a third side edge c and a fourth side edge d that are disposed respectively opposite to the first side edge a and the second side edge b. The support 12 includes a first side surface and a second side surface that are adjacent to each other, and a third side surface and a fourth side surface that are respectively opposite to the first side surface and the second side surface. A projection of the second side surface of the support 12 on the horizontal plane falls on a straight line of the second side edge b of the clearance area 11, and coincides with at least a part of the second side edge b of the clearance area 11. A distance between a projection of the support 12 on the horizontal plane and each of the third side edge c and the fourth side edge d of the clearance area 11 is 0 mm to 5 mm. The first side surface of the support 12 is outside the clearance area 11.

The clearance area 11 may be a quadrangle having the foregoing four side edges, and a specific shape of the clearance area 11 is not limited. The clearance area 11 and the support 12 are arranged in the foregoing location relationship, so that the size of the clearance area 11 can be reduced to the greatest extent, thereby reducing the size of the antenna module to the greatest extent.

That a distance between a projection of the support 12 on the horizontal plane and each of the third side edge c and the fourth side edge d of the clearance area 11 is 0 mm to 5 mm means that: a distance between a projection of the third side surface of the support 12 on the horizontal plane and the third side edge c of the clearance area 11 and a distance between a projection of the fourth side surface of the support 12 on the horizontal plane and the fourth side edge d of the clearance area 11 are any values within a range of 0 mm to 5 mm. A longer distance indicates that the surface currents on the branch 13 can be more effectively centralized on the edge of the clearance area 11, and a shorter distance indicates that the size of the clearance area 11 can be more effectively reduced.

Specific extension manners of the at least two branches 13 on the support 12 are not limited. Different extension manners of the at least two branches 13 lead to generation of different mutual coupling. A specific setting principle is that: the support 12 and the at least two branches 13 are designed in a combined manner, so that branches interfering with each other are away from each other as far as possible based on a required band.

Figure 3:
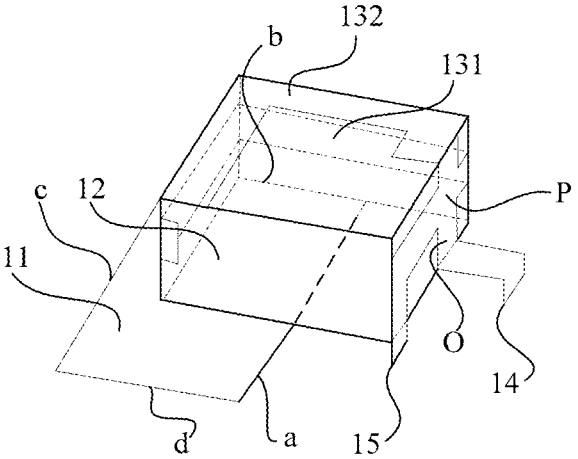
FIG. 3 is a schematic structural diagram showing that a first feed branch and a second feed branch that are based on FIG. 2 are disposed on a support according to an embodiment of this application.
Figure 5:
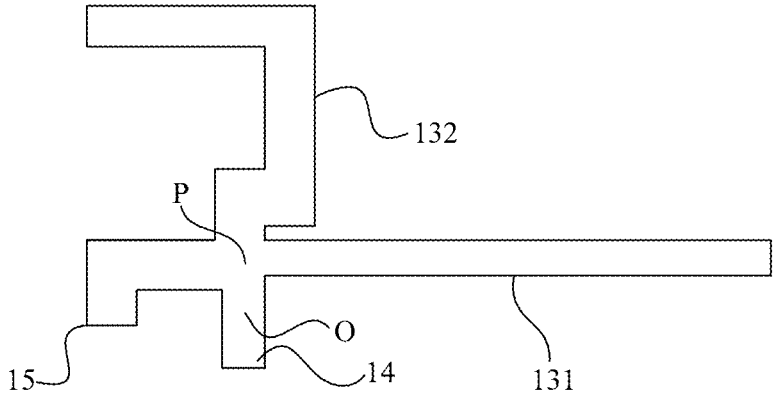
FIG. 5 is a schematic structural stretch-out view of a first feed branch and a second feed branch in an antenna module shown in FIG. 3 according to an embodiment of this application.

In an embodiment of this application, referring to FIG. 3 and FIG. 5, the at least two branches 13 include a first feed branch 131 and a second feed branch 132; and the antenna module further includes the feed point 14 and a ground point 15. One end O that is of the first feed branch 131 and that is configured to connect to the feed point 14 is disposed on the first side surface of the support 12, and extends to the second side surface of the support 12 along the first side surface of the support 12. The ground point 15 is connected to the first feed branch 131 on the first side surface of the support 12. One end P that is of the second feed branch 132 and that is configured to connect to the feed point 14 is connected to the first feed branch 131 on the first side surface of the support 12, and extends to an upper surface of the support 12 along the first side surface of the support 12. A length of the first feed branch 131 is ¼ of a wavelength corresponding to a first preset band, and a length of the second feed branch 132 is ⅛ of a wavelength corresponding to a second preset band.

The two feed branches (131 and 132) are disposed on the support 12, and locations and the lengths of the two feed branches (131 and 132) are adjusted, so that the antenna module operates in the first preset band and the second preset band. In addition, because of relative location relationships between the two feed branches (131 and 132) and the clearance area 11, the surface currents on the two feed branches (131 and 132) are centralized on the edge of the clearance area 11, and the currents distributed on the ground plate can be reduced, thereby reducing current coupling between the antenna modules. Further, the two feed branches (131 and 132) are respectively disposed on a side surface and the upper surface of the support 12, to reduce a size of the support 12 as much as possible while ensuring that the two feed branches (131 and 132) independently operate, thereby further reducing the size of the antenna module.

A connection between the ground point 15 and the first feed branch 131 on the first side surface of the support 12 is not limited. The ground point 15 may be connected, by using a ground branch, to the end that is of the first feed branch 131 and that is configured to connect to the feed point 14, or the ground point 15 may be directly disposed on the first feed branch 131 on the first side surface of the support 12. Referring to FIG. 3 and FIG. 5, when the ground point 15 is connected, by using the ground branch, to the end that is of the first feed branch 131 and that is configured to connect to the feed point 14, the length of the first feed branch 131 is equal to a sum of a length of the ground branch and a length from the end connected to the feed point to the tail end of the first feed branch 131. When the ground point 15 is directly disposed on the first feed branch 131 on the first side surface of the support 12 (not shown), the length of the first branch 131 is a length from the end that is of the first branch 131 and that is configured to connect to the feed point 14 to the tail end of the first branch 131.

The first preset band and the second preset band are not limited. Relative location relationships between the support 12 and the first feed branch 131 and the second feed branch 132 may be adjusted, so that the first feed branch 131 and the second feed branch 132 independently operate, and resonate in required different bands.

A band of PCS 1880 MHz to 1920 MHz and a band of ITE 2300 MHz to 2700 MHz are most frequently used bands. Therefore, in this embodiment of this application, a relative location relationship between the support 12 and each branch 13 is adjusted, and the first band and the second band may be any two medium or high bands in the band of PCS 1880 MHz to 1920 MHz and the band of ITE 2300 MHz to 2700 MHz.

In an embodiment of this application, the first preset band is ITE 2300 MHz, and the second preset band is 2700 MHz.

Figure 4:
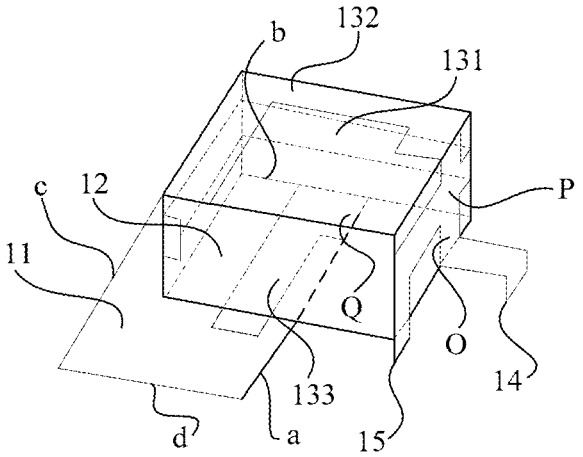
FIG. 4 is a schematic structural diagram showing that a parasitic branch is added based on FIG. 3 according to an embodiment of this application.
Figure 6:
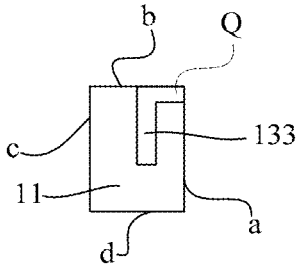
FIG. 6 is a schematic structural diagram of a clearance area and a parasitic branch in an antenna module shown in FIG. 4 according to an embodiment of this application.

In another embodiment of this application, referring to FIG. 4 and FIG. 6, the at least two branches 13 further include a parasitic branch 133. The parasitic branch 133 is disposed inside the clearance area 11, and one end Q of the parasitic branch 133 is connected to the first side edge a of the clearance area 11; and a length of the parasitic branch 133 is 1/10 of a wavelength corresponding to a third preset band.

In this embodiment of this application, the parasitic branch 133 is added, and a location and the length of the parasitic branch 133 are adjusted, so that the parasitic branch 133 resonates in the third preset band, and the antenna module operates in three bands, thereby improving performance of the antenna module.

In an embodiment of this application, the third preset band is PCS 1880 MHz. The band of PCS 1880 MHz to 1920 MHz and the band of ITE 2300 MHz to 2700 MHz are most frequently used bands in wireless communications. Therefore, the antenna module can operate in the most frequently used bands, thereby improving the performance of the antenna module. In addition, because of corresponding location relationships between the three branches (131, 132, and 133) and the clearance area 11, the surface currents on the three branches (131, 132, and 133) can be centralized on the edge of the clearance area 11, and the currents distributed on the ground plate can be reduced, thereby reducing current coupling between the antenna modules. When the antenna module is applied to the MIMO antenna, the size of the MIMO antenna can be reduced to the greatest extent, and current coupling in the MIMO antenna can be reduced, thereby improving performance of the MIMO antenna.

Figure 7:
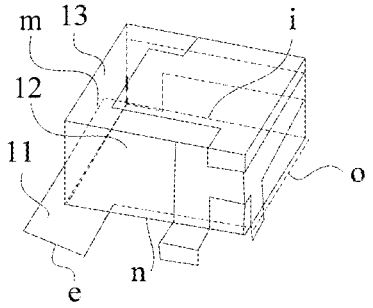
FIG. 7 is a schematic structural diagram of still another antenna module according to an embodiment of this application.
Figure 8:
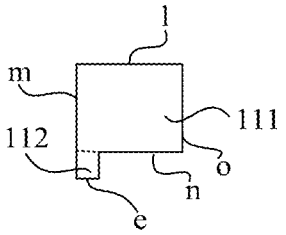
FIG. 8 is a schematic structural diagram of a clearance area in the antenna module shown in FIG. 7 according to an embodiment of this application.

In an embodiment of this application, referring to FIG. 7 and FIG. 8, the clearance area 11 includes a first area 111 and a second area 112 that are orthogonal to each other. The first area 111 includes a side edge-I i and a side edge-II m that are adjacent to each other, and a side edge-III n and a side edge-IV o that are disposed respectively opposite to the side edge-I i and the side edge-II m. The second area 112 is a structure that extends out along a length direction of the side edge-II m of the first area 111. The support 12 includes a first side surface and a second side surface that are adjacent to each other, and a third side surface and a fourth side surface that are respectively opposite to the first side surface and the second side surface. A projection of the third side surface of the support 12 on the horizontal plane coincides with the side edge-I i of the first area 111. A projection of the second side surface of the support 12 on the horizontal plane falls on a straight line of the side edge-IV o of the first area 111, and coincides with a part of the side edge-IV o of the first area 111. A distance between a projection of the support 12 on the horizontal plane and each of the side edge-II m of the first area 111 and a side edge e that is of the second area 112 and that is far away from the first area 111 is 0 mm to 5 mm. A partial projection of the first side surface of the support 12 on the horizontal plane is outside the clearance area 11.

The clearance area 11 may be any structure having the first area 111 and the second area 112 that are orthogonal to each other, and a specific shape of the clearance area 11 is not limited. The clearance area 11 and the support 12 are arranged in the foregoing location relationship, so that a size of the clearance area 11 can be reduced to the greatest extent, thereby reducing a size of the antenna module to the greatest extent.

That a distance between a projection of the support 12 on the horizontal plane and each of the side edge-II m of the first area 111 and a side edge e that is of the second area 112 and that is far away from the first area 111 is 0 mm to 5 mm means that: a distance between a projection of the fourth side surface of the support 12 on the horizontal plane and the side edge-II m of the first area 111 is any value within the range of 0 mm to 5 mm, and a distance between a partial projection of the first side surface of the support 12 on the horizontal plane and the side edge e that is of the second area 112 and that is far away from the first area 111 is any value within the range of 0 mm to 5 mm. A longer distance indicates that the surface currents on the branch 13 can be more effectively centralized on the edge of the clearance area 11, and a shorter distance indicates that the size of the clearance area 11 can be more effectively reduced.

Specific extension manners of the at least two branches 13 on the support 12 are not limited. Different extension manners of the at least two branches 13 lead to generation of different mutual coupling. A specific setting principle is that: the support 12 and the at least two branches 13 are designed in a combined manner, so that branches interfering with each other are away from each other as far as possible based on a required band.

Figure 9:
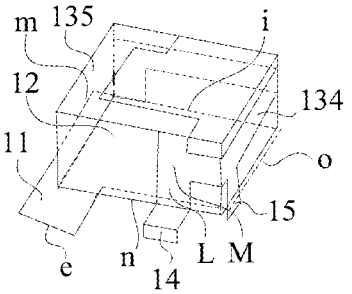
FIG. 9 is a schematic structural diagram showing that a feed branch-I and a feed branch-II that are based on FIG. 7 are disposed on a support according to an embodiment of this application.
Figure 11:
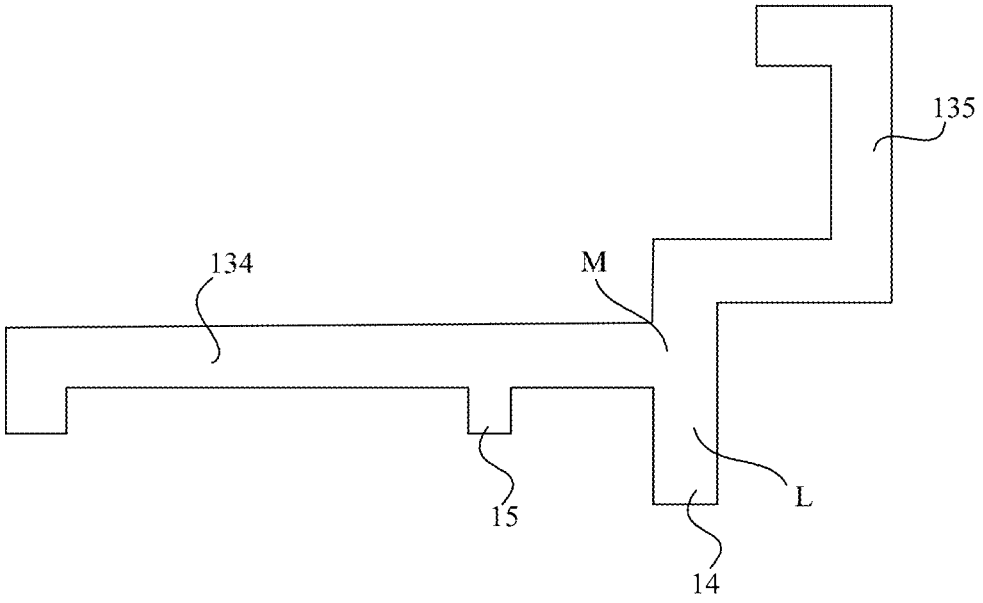
FIG. 11 is a schematic structural stretch-out view of the feed branch-I and the feed branch-II shown in FIG. 9 according to an embodiment of this application.

In an embodiment of this application, referring to FIG. 9 and FIG. 11, the at least two branches 13 include a feed branch-I 134 and a feed branch-II 135, and the antenna module further includes the feed point 14 and a ground point 15. One end L that is of the feed branch-I 134 and that is configured to connect to the feed point 14 is connected to the feed point 14. A first end of the feed branch-I 134 is disposed on the first side surface of the support 12, and extends to the second side surface of the support 12 along the first side surface of the support 12. The ground point 15 is disposed on the feed branch-I 134 on the second side surface of the support 12. One end M that is of the feed branch-II 135 and that is configured to connect to the feed point is connected to the feed branch-I 134 on the first side surface of the support 12, and extends to an upper surface of the support 12 along the first side surface of the support 12. A length of the feed branch-I 134 is ¼ of a wavelength corresponding to a first preset band, and a length of the feed branch-II 135 is ⅛ of a wavelength corresponding to a second preset band.

The two feed branches (134 and 135) are disposed on the support 12, and locations and the lengths of the two feed branches (134 and 135) are adjusted, so that the antenna module operates in the first preset band and the second preset band. In addition, because of relative location relationships between the two feed branches (134 and 135) and the clearance area 11, the surface currents on the two feed branches (134 and 135) are centralized on the edge of the clearance area 11, and the currents distributed on the ground plate can be reduced. Further, the two feed branches (134 and 135) are respectively disposed on a side surface and the upper surface of the support 12, to reduce a size of the support 12 as much as possible while ensuring that the two feed branches (134 and 135) independently operate, thereby further reducing the size of the antenna module.

The first preset band and the second preset band are not limited. Relative location relationships between the support 12 and the feed branch-I 134 and the feed branch-II 135 may be adjusted, so that the feed branch-I 134 and the feed branch-II 135 independently operate, and resonate in required different bands.

A band of PCS 1880 MHz to 1920 MHz and a band of ITE 2300 MHz to 2700 MHz are most frequently used bands. Therefore, in this embodiment of this application, a relative location relationship between the support 12 and each branch 13 is adjusted, and the first band and the second band may be any two medium or high bands in the band of PCS 1880 MHz to 1920 MHz and the band of ITE 2300 MHz to 2700 MHz.

In an embodiment of this application, the first preset band is ITE 2300 MHz, and the second preset band is 2700 MHz.

Figure 10:
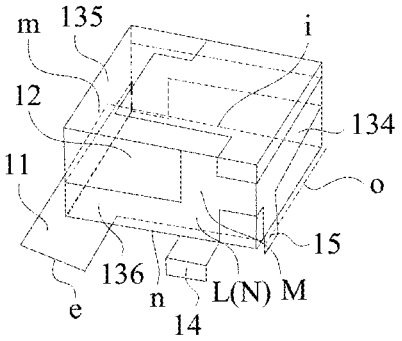
FIG. 10 is a schematic structural diagram showing that a feed branch-III is added based on FIG. 9 according to an embodiment of this application.
Figure 12:
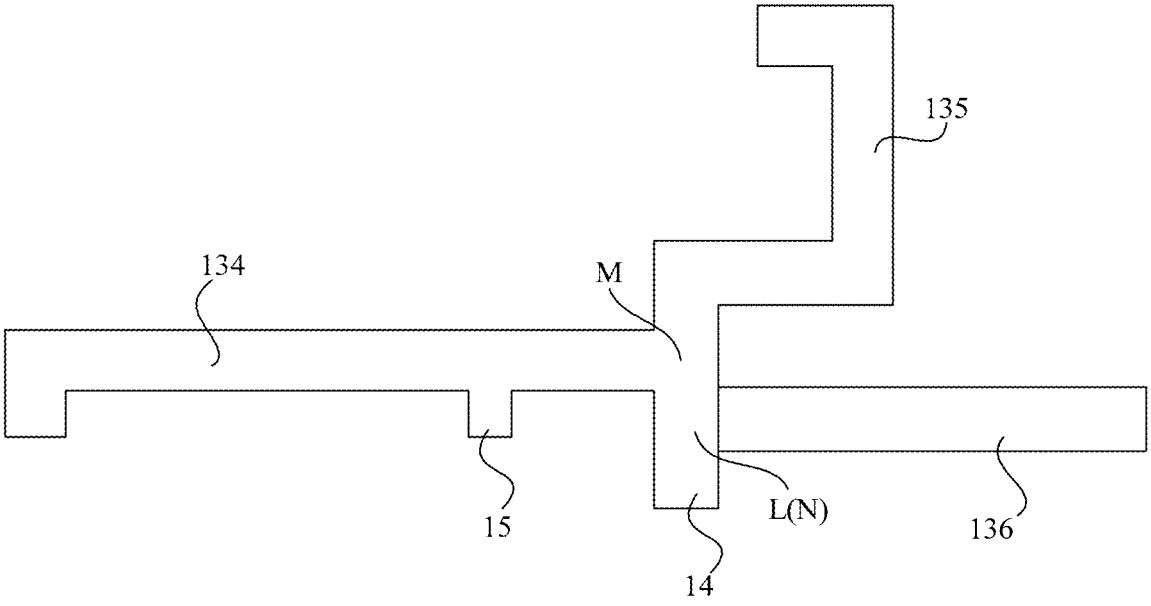
FIG. 12 is a schematic structural stretch-out view of the feed branch-I, the feed branch-II, and the feed branch-III shown in FIG. 10 according to an embodiment of this application.

In another embodiment of this application, referring to FIG. 10 and FIG. 12, the at least two branches further include a feed branch-III 136. One end N that is of the feed branch-III 136 and that is configured to connect to the feed point 14 is connected to the feed branch-II 135 on the first side surface of the support 12, and extends to the fourth side surface of the support 12 along the first side surface of the support 12. A length of the feed branch-III 136 is ⅒ of a wavelength corresponding to a third preset band.

In this embodiment of this application, the feed branch-III 136 is added, and a location and the length of the feed branch-III 136 are adjusted, so that the feed branch-III 136 resonates in the third preset band, and the antenna module operates in three bands, thereby improving performance of the antenna module.

In an embodiment of this application, the third preset band is PCS 1880 MHz. The band of PCS 1880 MHz to 1920 MHz and the band of ITE 2300 MHz to 2700 MHz are most frequently used bands in wireless communications. Therefore, the antenna module can operate in the most frequently used bands, thereby improving the performance of the antenna module. In addition, because of corresponding location relationships between the three branches (134, 135, and 136) and the clearance area 11, the surface currents on the three branches (134, 135, and 136) can be centralized on the edge of the clearance area 11, and the currents distributed on the ground plate can be reduced. When the antenna module is applied to the MIMO antenna, the size of the MIMO antenna can be reduced to the greatest extent, and current coupling in the MIMO antenna can be reduced, thereby improving performance of the MIMO antenna.

Figure 13:
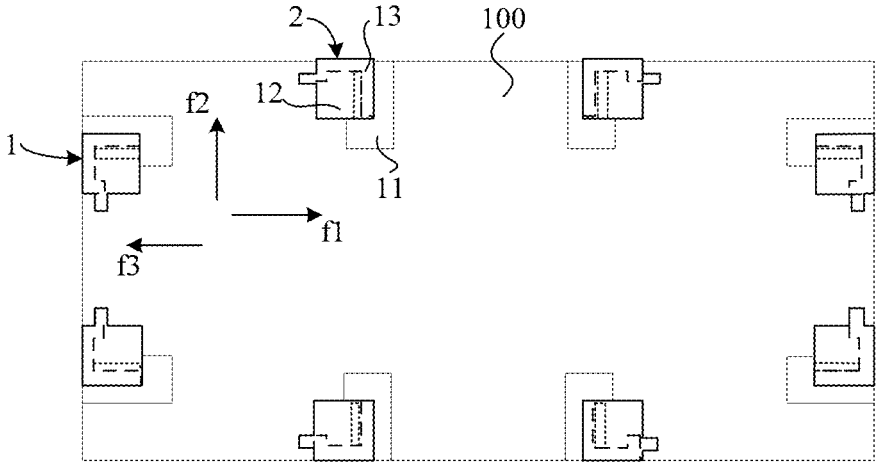
FIG. 13 is a schematic diagram of an arrangement manner of any two antenna modules shown in FIG. 4 according to an embodiment of this application.

According to a second aspect, an embodiment of this application provides a MIMO antenna. Referring to FIG. 13, the MIMO antenna includes a ground plate 100 and at least two antenna modules disposed on the ground plate 100. Each antenna module includes a clearance area 11, a support 12, and at least two branches 13.

Each branch 13 is disposed on the support 12. A partial projection of the support 12 on a horizontal plane falls within the clearance area 11. A projection, on the horizontal plane, of one end that is of each branch 13 and that is configured to connect to a feed point is outside the clearance area 11, and a projection of a tail end on the horizontal plane is inside the clearance area 11.

This embodiment of this application provides the MIMO antenna. The at least two branches 13 are disposed on the support 12, and the support 12 is placed on the clearance area 11, so that the partial projection of the support 12 on the horizontal plane is inside the clearance area 11, the projection, on the horizontal plane, of the end that is of each of the at least two branches 13 and that is connected to the feed point is outside the clearance area 11, and the projection of the tail end on the horizontal plane is inside the clearance area 11. In this way, space of the clearance area can be properly used, and a size of the clearance area can be reduced, thereby implementing miniaturization of the antenna module. Furthermore, the tail end of the branch 13 is disposed inside the clearance area 11, to complete resonance, so that surface currents on the branch 13 are centralized on an edge of the clearance area 11 as many as possible, and currents distributed on a ground plate are reduced. In addition, the at least two branches can resonate in different bands, so that the antenna module can operate in a plurality of bands. Therefore, the antenna module can operate at a plurality of frequencies, and a size of the antenna module can be reduced, thereby implementing the miniaturization of the antenna module. When the antenna module is applied to the MIMO antenna, a size of the MIMO antenna can be reduced.

In an embodiment of this application, referring to FIG. 2, the clearance area 11 includes a first side edge a and a second side edge b that are adjacent to each other, and a third side edge c and a fourth side edge d that are disposed respectively opposite to the first side edge a and the second side edge b. The support 12 includes a first side surface and a second side surface that are adjacent to each other, and a third side surface and a fourth side surface that are respectively opposite to the first side surface and the second side surface. A projection of the second side surface of the support 12 on the horizontal plane falls on a straight line of the second side edge b of the clearance area 11, and coincides with at least a part of the second side edge b of the clearance area 11. A distance between a projection of the support 12 on the horizontal plane and each of the third side edge c and the fourth side edge d of the clearance area 11 is 0 mm to 5 mm. The first side surface of the support 12 is outside the clearance area 11.

The clearance area 11 and the support 12 are arranged in the foregoing location relationship, so that the size of the clearance area 11 can be reduced to the greatest extent, thereby reducing the size of the antenna module to the greatest extent, and ensuring multi-band performance and high isolation performance of the MIMO antenna.

In an embodiment of this application, referring to FIG. 3, the at least two branches 13 include a first feed branch 131 and a second feed branch 132; and the antenna module further includes the feed point 14 and a ground point 15. One end O that is of the first feed branch 131 and that is configured to connect to the feed point 14 is disposed on the first side surface of the support 12, and extends to the second side surface of the support 12 along the first side surface of the support 12. The ground point 15 is connected to the first feed branch 131 on the first side surface of the support 12. One end P that is of the second feed branch 132 and that is configured to connect to the feed point 14 is connected to the first feed branch 131 on the first side surface of the support 12, and extends to an upper surface of the support 12 along the first side surface of the support 12. A length of the first feed branch 131 is ¼ of a wavelength corresponding to a first preset band, and a length of the second feed branch 132 is ⅛ of a wavelength corresponding to a second preset band.

The two feed branches (131 and 132) are disposed on the support 12, and locations and the lengths of the two feed branches (131 and 132) are adjusted, so that the antenna module operates in the first preset band and the second preset band. In addition, because of relative location relationships between the two feed branches (131 and 132) and the clearance area 11, the surface currents on the two feed branches (131 and 132) are centralized on the edge of the clearance area 11, and the currents distributed on the ground plate can be reduced, thereby reducing current coupling between the antenna modules. Further, the two feed branches (131 and 132) are respectively disposed on a side surface and the upper surface of the support 12, to reduce a size of the support 12 as much as possible while ensuring that the two feed branches (131 and 132) independently operate, thereby further reducing the size of the antenna module.

The first preset band and the second preset band are not limited. Relative location relationships between the support 12 and the first feed branch 131 and the second feed branch 132 may be adjusted, so that the first feed branch 131 and the second feed branch 132 independently operate, and resonate in required different bands.

A band of PCS 1880 MHz to 1920 MHz and a band of ITE 2300 MHz to 2700 MHz are most frequently used bands. Therefore, in this embodiment of this application, a relative location relationship between the support 12 and each branch 13 is adjusted, and the first band and the second band may be any two medium or high bands in the band of PCS 1880 MHz to 1920 MHz and the band of ITE 2300 MHz to 2700 MHz.

In an embodiment of this application, the first preset band is ITE 2300 MHz, and the second preset band is 2700 MHz.

In another embodiment of this application, referring to FIG. 4 and FIG. 6, the at least two branches 13 further include a parasitic branch 133. The parasitic branch 133 is disposed inside the clearance area 11, and one end Q of the parasitic branch 133 is connected to the first side edge a of the clearance area 11; and a length of the parasitic branch 133 is 1/10 of a wavelength corresponding to a third preset band.

In this embodiment of this application, the parasitic branch 133 is added, and a location and the length of the parasitic branch 133 are adjusted, so that the parasitic branch 133 resonates in the third preset band, and the antenna module operates in three bands, thereby improving performance of the antenna module.

In an embodiment of this application, the third preset band is PCS 1880 MHz. The band of PCS 1880 MHz to 1920 MHz and the band of ITE 2300 MHz to 2700 MHz are most frequently used bands in wireless communications. Therefore, the antenna module can operate in the most frequently used bands, thereby improving the performance of the antenna module. In addition, because of corresponding location relationships between the three branches (131, 132, and 133) and the clearance area 11, the surface currents on the three branches (131, 132, and 133) can be centralized on the edge of the clearance area 11, and the currents distributed on the ground plate can be reduced. When the antenna module is applied to the MIMO antenna, the size of the MIMO antenna can be reduced to the greatest extent, and current coupling in the MIMO antenna can be reduced, thereby improving performance of the MIMO antenna.

During actual application, a distance between the antenna modules in the MIMO antenna is ½ of a wavelength corresponding to a band covered by the antenna module. In this case, a relative location relationship between any two adjacent antenna modules is not limited.

Figure 14:
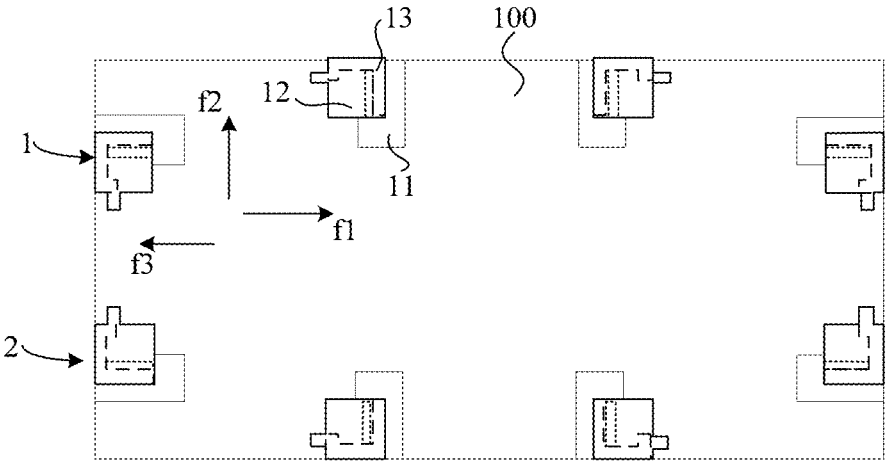
FIG. 14 is a schematic diagram of another arrangement manner of any two antenna modules shown in FIG. 4 according to an embodiment of this application.
Figure 15:
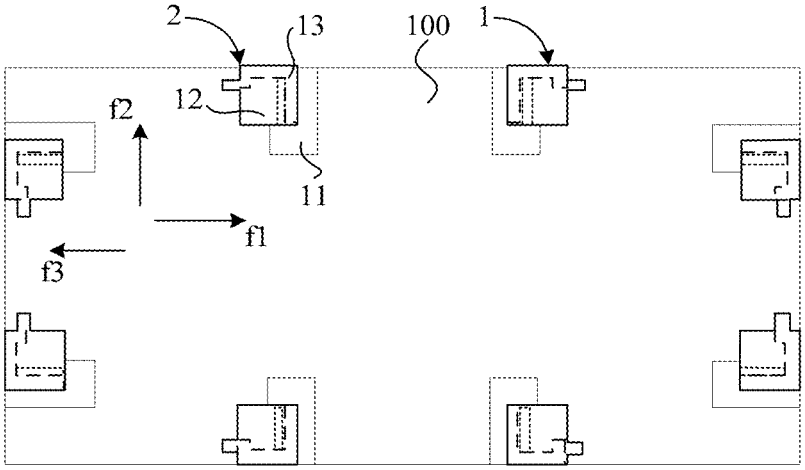
FIG. 15 is a schematic diagram of another arrangement manner of any two antenna modules shown in FIG. 4 according to an embodiment of this application.
Figure 16:
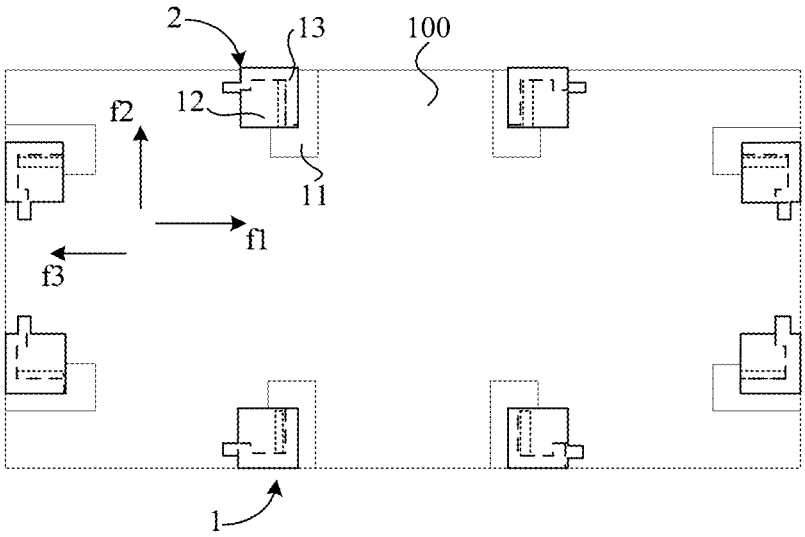
FIG. 16 is a schematic diagram of another arrangement manner of any two antenna modules shown in FIG. 4 according to an embodiment of this application.

In an embodiment of this application, the at least two antenna modules include a first antenna module 1 and a second antenna module 2. The first antenna module 1 and the second antenna module 2 are any two adjacent antenna modules. Referring to FIG. 13, if the first antenna module 1 and the second antenna module 2 have a same structure, the first antenna module 1 and the second antenna module 2 are sequentially arranged in a staggered manner in a first direction f1 and a second direction f2, a second side surface of the first antenna module 1 faces a third direction f3 opposite to the first direction f1, and a second side surface of the second antenna module 2 faces the second direction f2, a distance between feed points 14 of the two adjacent antenna modules is greater than or equal to ¼ of a wavelength corresponding to a lowest band covered by the antenna module; or (not shown), if the first antenna module 1 and the second antenna module 2 are mirror symmetric, the first antenna module 1 and the second antenna module 2 are sequentially arranged in a staggered manner in a first direction f1 and a second direction f2, a second side surface of the first antenna module 1 faces a third direction f3 opposite to the first direction f1, and a second side surface of the second antenna module 2 faces the second direction f2, a distance between feed points 14 of the two adjacent antenna modules is greater than or equal to ¼ of a wavelength corresponding to a lowest band covered by the antenna module. Referring to FIG. 14, if the first antenna module 1 and the second antenna module 2 are mirror symmetric and have reverse feed directions, a distance between feed points 14 of the two adjacent antenna modules is greater than or equal to ⅛ of a wavelength corresponding to a lowest band covered by the antenna module. Referring to FIG. 15, if the first antenna module 1 and the second antenna module 2 are mirror symmetric and have opposite feed directions, a distance between feed points 14 of the two adjacent antenna modules is greater than or equal to ¼ of a wavelength corresponding to a lowest band covered by the antenna module. Referring to FIG. 16, if the first antenna module 1 and the second antenna module 2 are mirror symmetric and have a same feed direction, and fourth side surfaces of the two adjacent antenna modules are disposed opposite to each other, a distance between feed points 14 of the two adjacent antenna modules is greater than or equal to ¼ of a wavelength corresponding to a lowest band covered by the antenna module.

In this embodiment of this application, the any two adjacent antenna modules are arranged in the foregoing manner, so that a distance between the antenna modules can be reduced while ensuring normal operation of the antenna module, thereby reducing the size of the MIMO antenna when the MIMO antenna is formed by using a same quantity of antenna modules.

A quantity of antenna modules is not limited, and a maximum quantity of antenna modules can be accommodated based on a size of an application terminal, thereby improving performance of the application terminal.

In an embodiment of this application, there are two to eight antenna modules.

It should be noted that, when there are two antenna modules, a location relationship between the two antenna modules satisfies any one of the foregoing five cases. When there are three antenna modules, referring to FIG. 17, a location relationship between any two (herein, using a first antenna module 1 and a second antenna module 2 as an example) of the three antenna modules satisfies any one of the foregoing five cases, a location relationship between the other antenna module (using a third antenna module 3 as an example) and the first antenna module 1 satisfies any one of the foregoing five cases, and a location relationship between the third antenna module 3 and the second antenna module 2 also satisfies any one of the foregoing five cases. Similarly, when there are four antenna modules, a location relationship between any two (herein, using a first antenna module 1 and a second antenna module 2 as an example) of the four antenna modules satisfies any one of the foregoing five cases, a location relationship between one (using a third antenna module 3 as an example) of the other two antenna modules (using the third antenna module 3 and a fourth antenna module 4 as an example) and the first antenna module 1 satisfies any one of the foregoing five cases, a location relationship between the third antenna module 3 and the second antenna module 2 also satisfies any one of the foregoing five cases, a location relationship between the fourth antenna module 4 and the first antenna module 1 satisfies any one of the foregoing five cases, a location relationship between the fourth antenna module 4 and the second antenna module 2 also satisfies any one of the foregoing five cases, and a location relationship between the fourth antenna module 4 and the third antenna module 3 also satisfies any one of the foregoing five cases. When there are five, six, seven, or eight antenna modules, the antenna modules are disposed according to the foregoing rule, and details are not described herein.

Figure 17:
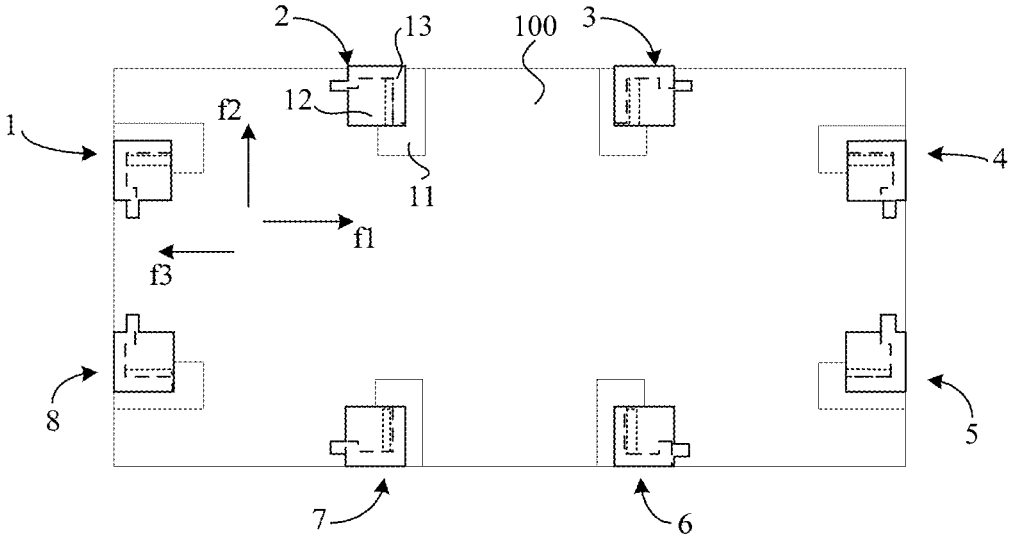
FIG. 17 is a schematic diagram of an arrangement manner of eight antenna modules shown in FIG. 4 according to an embodiment of this application.

In an embodiment of this application, referring to FIG. 17, when there are eight antenna modules, the eight antenna modules (1 to 8) are sequentially arranged to enclose a first enclosed area, and a second side surface of each antenna module faces the exterior of the first enclosed area. By means of the structure, a size of an eight-unit MIMO antenna can be reduced to the greatest extent, thereby improving compactness of the eight-unit MIMO antenna, and implementing a miniaturization design of the eight-unit MIMO antenna.

The eight antenna modules (1 to 8) are sequentially arranged to enclose the first enclosed area. For example, referring to FIG. 17, the first antenna module 1 and the second antenna module 2 have a same structure, the first antenna module 1 and the second antenna module 2 are sequentially arranged in a staggered manner in the first direction f1 and the second direction f2, a second side surface of the first antenna module 1 faces the third direction f3 opposite to the first direction f1, a second side surface of the second antenna module 2 faces the second direction f2, and a distance between feed points 14 of the two adjacent antenna modules is equal to ¼ of a wavelength corresponding to a lowest band covered by the antenna module. The second antenna module 2 and the third antenna module 3 are mirror symmetric and have opposite feed directions, and a distance between feed points 14 of the two adjacent antenna modules is equal to ¼ of a wavelength corresponding to a lowest band covered by the antenna module. The third antenna module 3 and the fourth antenna module 4 have a same structure, a location relationship between the fourth antenna module 4 and the third antenna module 3 and a location relationship between the first antenna module 1 and the second antenna module 2 are in a one-to-one correspondence and are mirror symmetric. The fourth antenna module 4 and the fifth antenna module 5 are mirror symmetric and have reverse feed directions, and a distance between feed points 14 of the two adjacent antenna modules is equal to ⅛ of a wavelength corresponding to a lowest band covered by the antenna module. A location relationship between the sixth antenna module 6 and the fifth antenna module 5 and the location relationship between the third antenna module 3 and the fourth antenna module are in a one-to-one correspondence and are mirror symmetric. The seventh antenna module 7 and the sixth antenna module 6 are mirror symmetric and have opposite feed directions, and a distance between feed points 14 of the sixth antenna module 6 and the seventh antenna module 7 is equal to ¼ of a wavelength corresponding to a lowest band covered by the antenna module. A location relationship between the eighth antenna module 8 and the seventh antenna module 7 and a location relationship between the first antenna module 1 and the second antenna module 2 are in a one-to-one correspondence and are mirror symmetric. The second side surfaces of the eight antenna modules all face the exterior of the first enclosed area.

A size of the ground plate 100 is not limited. In an embodiment of this application, the second side surfaces of the eight antenna modules are disposed close to edges of the ground plate 100. By means of the structure, the size of the MIMO antenna can be reduced to the greatest extent, thereby increasing space occupied by the MIMO antenna in the terminal. A requirement for miniaturization of the terminal is met when there are a particular quantity of antenna modules, thereby improving the performance of the terminal.

In an embodiment of this application, referring to FIG. 7 and FIG. 8, the clearance area 11 includes a first area 111 and a second area 112 that are orthogonal to each other. The first area 111 includes a side edge-I i and a side edge-II m that are adjacent to each other, and a side edge-III n and a side edge-IV o that are disposed respectively opposite to the side edge-I i and the side edge-II m. The second area 112 is a structure that extends out along a length direction of the side edge-II m of the first area 111. The support 12 includes a first side surface and a second side surface that are adjacent to each other, and a third side surface and a fourth side surface that are respectively opposite to the first side surface and the second side surface. A projection of the third side surface of the support 12 on the horizontal plane coincides with the side edge-I i of the first area 111. A projection of the second side surface of the support 12 on the horizontal plane falls on a straight line of the side edge-IV o of the first area 111, and coincides with a part of the side edge-IV o of the first area 111. A distance between a projection of the support 12 on the horizontal plane and each of the side edge-II m of the first area 111 and a side edge e that is of the second area 112 and that is far away from the first area 111 is 0 mm to 5 mm. A partial projection of the first side surface of the support 12 on the horizontal plane is outside the clearance area 11.

The clearance area 11 and the support 12 are arranged in the foregoing location relationship, so that the size of the clearance area 11 can be reduced to the greatest extent, thereby reducing the size of the antenna module to the greatest extent, and ensuring multi-band performance and high isolation performance of the MIMO antenna.

In an embodiment of this application, referring to FIG. 9 and FIG. 11, the at least two branches 13 include a feed branch-I 134 and a feed branch-II 135, and the antenna module further includes the feed point 14 and a ground point 15. One end L that is of the feed branch-I 134 and that is configured to connect to the feed point 14 is connected to the feed point 14. A first end of the feed branch-I 134 is disposed on the first side surface of the support 12, and extends to the second side surface of the support 12 along the first side surface of the support 12. The ground point 15 is disposed on the feed branch-I 134 on the second side surface of the support 12. One end M that is of the feed branch-II 135 and that is configured to connect to the feed point is connected to the feed branch-I 134 on the first side surface of the support 12, and extends to an upper surface of the support 12 along the first side surface of the support 12. A length of the feed branch-I 134 is ¼ of a wavelength corresponding to a first preset band, and a length of the feed branch-II 135 is ⅛ of a wavelength corresponding to a second preset band.

The two feed branches (134 and 135) are disposed on the support 12, and locations and the lengths of the two feed branches (134 and 135) are adjusted, so that the antenna module operates in the first preset band and the second preset band. In addition, because of relative location relationships between the two feed branches (134 and 135) and the clearance area 11, the surface currents on the two feed branches (134 and 135) are centralized on the edge of the clearance area 11, and the currents distributed on the ground plate can be reduced, thereby reducing current coupling between the antenna modules. Further, the two feed branches (134 and 135) are respectively disposed on a side surface and the upper surface of the support 12, to reduce a size of the support 12 as much as possible while ensuring that the two feed branches (134 and 135) independently operate, thereby further reducing the size of the antenna module.

The first preset band and the second preset band are not limited. Relative location relationships between the support 12 and the feed branch-I 134 and the feed branch-II 135 may be adjusted, so that the feed branch-I 134 and the feed branch-II 135 independently operate, and resonate in required different bands.

A band of PCS 1880 MHz to 1920 MHz and a band of ITE 2300 MHz to 2700 MHz are most frequently used bands. Therefore, in this embodiment of this application, a relative location relationship between the support 12 and each branch 13 is adjusted, and the first band and the second band may be any two medium or high bands in the band of PCS 1880 MHz to 1920 MHz and the band of ITE 2300 MHz to 2700 MHz.

In an embodiment of this application, the first preset band is ITE 2300 MHz, and the second preset band is 2700 MHz.

In another embodiment of this application, referring to FIG. 10 and FIG. 12, the at least two branches further include a feed branch-III 136. One end N that is of the feed branch-III 136 and that is configured to connect to the feed point 14 is connected to the feed branch-II 135 on the first side surface of the support 12, and extends to the fourth side surface of the support 12 along the first side surface of the support 12. A length of the feed branch-III 136 is ⅒ of a wavelength corresponding to a third preset band.

In this embodiment of this application, the feed branch-III 136 is added, and a location and the length of the feed branch-III 136 are adjusted, so that the feed branch-III 136 resonates in the third preset band, and the antenna module operates in three bands, thereby improving performance of the antenna module.

In an embodiment of this application, the third preset band is PCS 1880 MHz. The band of PCS 1880 MHz to 1920 MHz and the band of ITE 2300 MHz to 2700 MHz are most frequently used bands in wireless communications. Therefore, the antenna module can operate in the most frequently used bands, thereby improving the performance of the antenna module. In addition, because of corresponding location relationships between the three branches (134, 135, and 136) and the clearance area 11, the surface currents on the three branches (134, 135, and 136) can be centralized on the edge of the clearance area 11, and the currents distributed on the ground plate can be reduced. When the antenna module is applied to the MIMO antenna, the size of the MIMO antenna can be reduced to the greatest extent, and current coupling in the MIMO antenna can be reduced, thereby improving performance of the MIMO antenna.

During actual application, a distance between the antenna modules in the MIMO antenna is ½ of a wavelength corresponding to a band covered by the antenna module. In this case, a relative location relationship between any two adjacent antenna modules is not limited.

Figure 18:
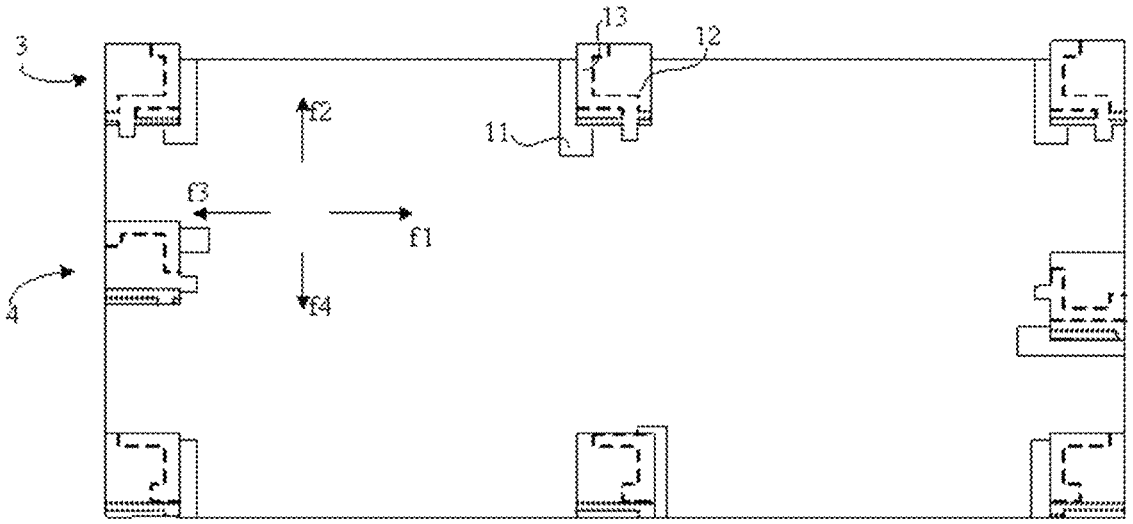
FIG. 18 is a schematic diagram of an arrangement manner of any two antenna modules shown in FIG. 10 according to an embodiment of this application.
Figure 19:
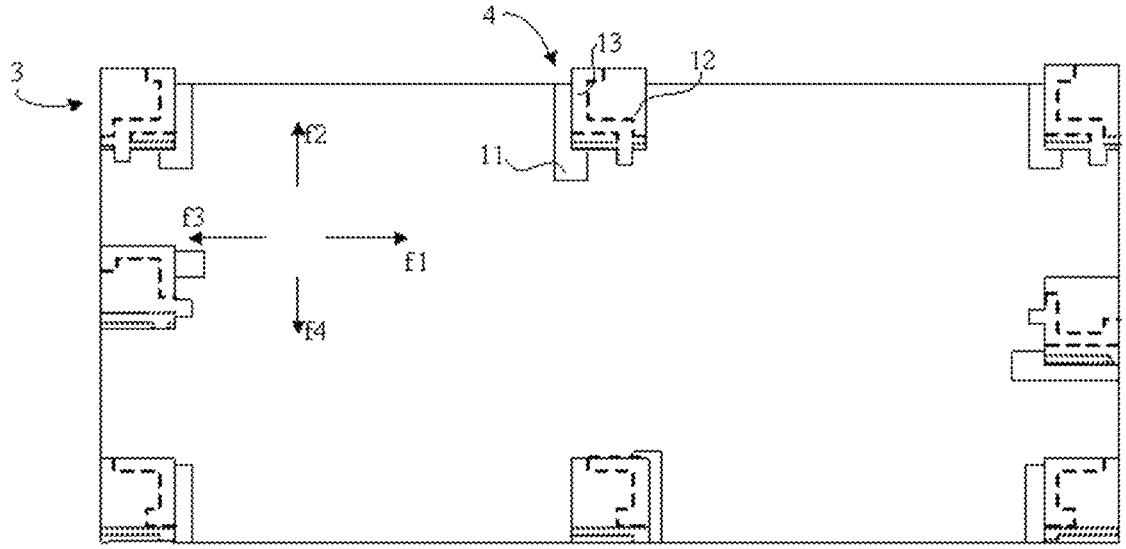
FIG. 19 is a schematic diagram of another arrangement manner of any two antenna modules shown in FIG. 10 according to an embodiment of this application.
Figure 20:
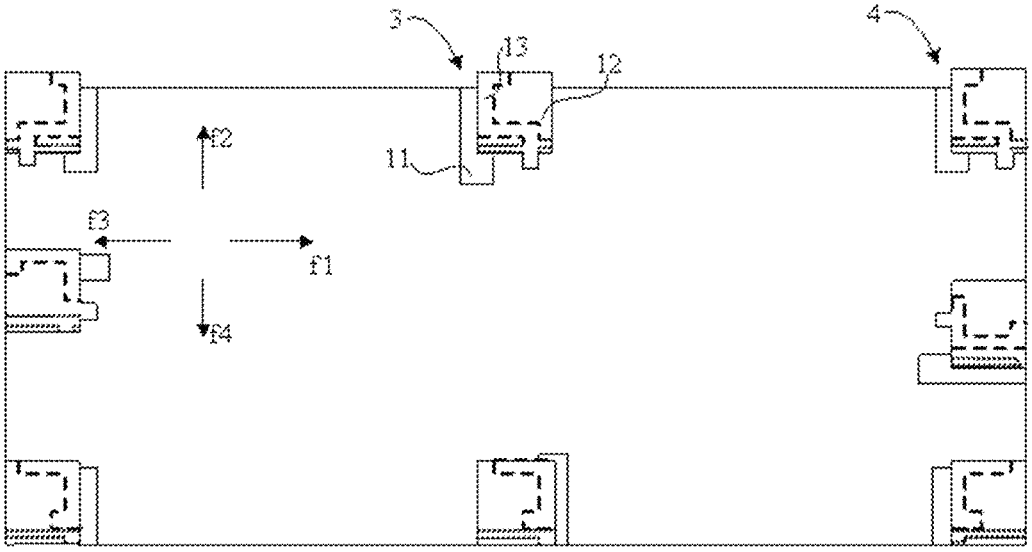
FIG. 20 is a schematic diagram of another arrangement manner of any two antenna modules shown in FIG. 10 according to an embodiment of this application.
Figure 21:
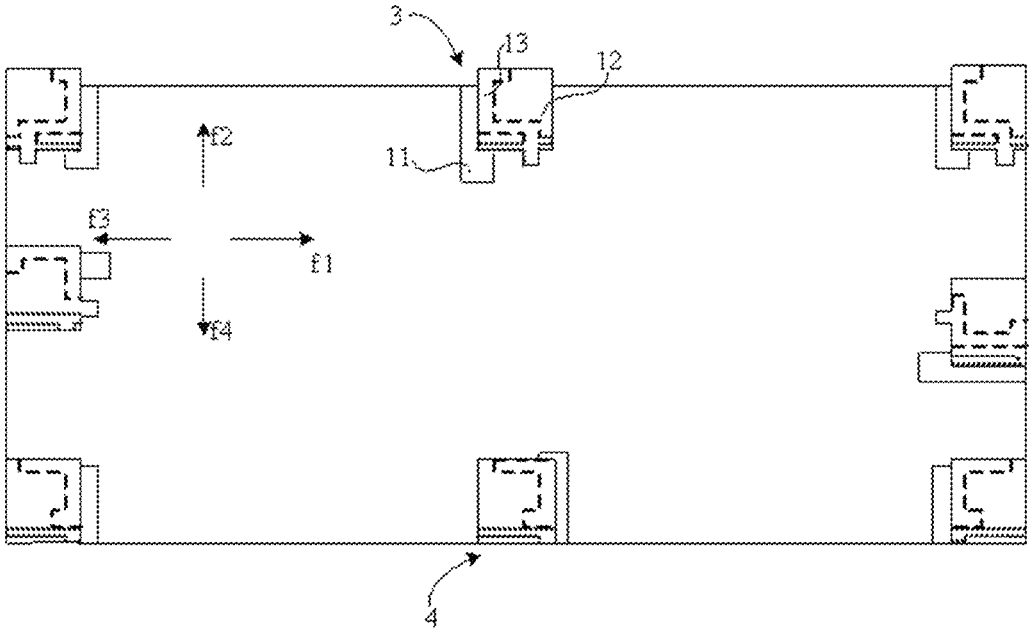
FIG. 21 is a schematic diagram of another arrangement manner of any two antenna modules shown in FIG. 10 according to an embodiment of this application.
Figure 22:
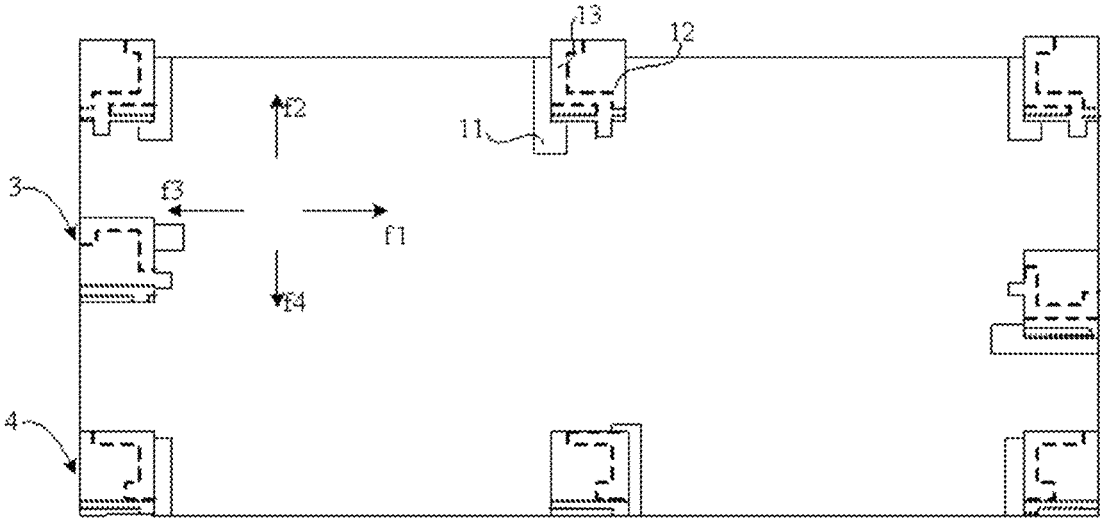
FIG. 22 is a schematic diagram of still another arrangement manner of any two antenna modules shown in FIG. 10 according to an embodiment of this application.

In an embodiment of this application, the at least two antenna modules include a third antenna module 3 and a fourth antenna module 4. The third antenna module 3 and the fourth antenna module 4 are any two adjacent antenna modules. Referring to FIG. 18, if the third antenna module 3 and the fourth antenna module 4 have a same structure and are disposed orthogonal to each other, the third antenna module 3 and the fourth antenna module 4 are sequentially arranged along a fourth direction f4 opposite to a second direction f2, and a first side surface of the third antenna module 3 is opposite to a fourth side surface of the fourth antenna module 4, a distance between feed points 14 of the two adjacent antenna modules is greater than or equal to ⅛ of a wavelength corresponding to a lowest band covered by the antenna module. Referring to FIG. 20, if the third antenna module 3 and the fourth antenna module 4 have a same structure and are sequentially arranged along a first direction f1 perpendicular to a fourth direction f4, and a fourth side surface of the third antenna module 3 is opposite to a first side surface or a second side surface of the fourth antenna module 4, a distance between feed points 14 of the two adjacent antenna modules is greater than or equal to ¼ of a wavelength corresponding to a lowest band covered by the antenna module. Referring to FIG. 21, if the third antenna module 3 and the fourth antenna module 4 have a same structure and have reverse feed directions and are sequentially arranged along a fourth direction f4, a distance between feed points 14 of the two adjacent antenna modules is greater than or equal to ¼ of a wavelength corresponding to a lowest band covered by the antenna module. Referring to FIG. 22, if the third antenna module 3 and the fourth antenna module 4 are mirror symmetric, are disposed orthogonal to each other and are sequentially arranged along a fourth direction f4, and a second side surface of the third antenna module 3 is opposite to a first side surface of the fourth antenna module 4, a distance between feed points 14 of the two adjacent antenna modules is greater than or equal to ⅛ of a wavelength corresponding to a lowest band covered by the antenna module. Referring to FIG. 19, if the third antenna module 3 and the fourth antenna module 4 are mirror symmetric and are sequentially arranged along a first direction f1, and a fourth side surface of the third antenna module 3 is opposite to a third side surface or a fourth side surface of the fourth antenna module 4, a distance between feed points 14 of the two adjacent antenna modules is greater than or equal to ¼ of a wavelength corresponding to a lowest band covered by the antenna module.

In this embodiment of this application, the any two adjacent antenna modules are arranged in the foregoing manner, so that a distance between the antenna modules can be reduced while ensuring isolation of the antenna modules, thereby reducing the size of the MIMO antenna when the MIMO antenna is formed by using a same quantity of antenna modules.

A quantity of antenna modules is not limited, and a maximum quantity of antenna modules can be accommodated based on a size of an application terminal, thereby improving performance of the application terminal.

In an embodiment of this application, there are two to eight antenna modules.

It should be noted that, when there are two antenna modules, a location relationship between the two antenna modules satisfies any one of the foregoing five cases. When there are three antenna modules, referring to FIG. 23, a location relationship between any two (herein, using a first antenna module 1 and a second antenna module 2 as an example) of the three antenna modules satisfies any one of the foregoing five cases, a location relationship between the other antenna module (using a third antenna module 3 as an example) and the first antenna module 1 satisfies any one of the foregoing five cases, and a location relationship between the third antenna module 3 and the second antenna module 2 also satisfies any one of the foregoing five cases. Similarly, when there are four antenna modules, a location relationship between any two (herein, using a first antenna module 1 and a second antenna module 2 as an example) of the four antenna modules satisfies any one of the foregoing five cases, a location relationship between one (using a third antenna module 3 as an example) of the other two antenna modules (using the third antenna module 3 and a fourth antenna module 4 as an example) and the first antenna module 1 satisfies any one of the foregoing five cases, a location relationship between the third antenna module 3 and the second antenna module 2 also satisfies any one of the foregoing five cases, a location relationship between the fourth antenna module 4 and the first antenna module 1 satisfies any one of the foregoing five cases, a location relationship between the fourth antenna module 4 and the second antenna module 2 also satisfies any one of the foregoing five cases, and a location relationship between the fourth antenna module 4 and the third antenna module 3 also satisfies any one of the foregoing five cases. When there are five, six, seven, or eight antenna modules, the antenna modules are disposed according to the foregoing rule, and details are not described herein.

Figure 23:
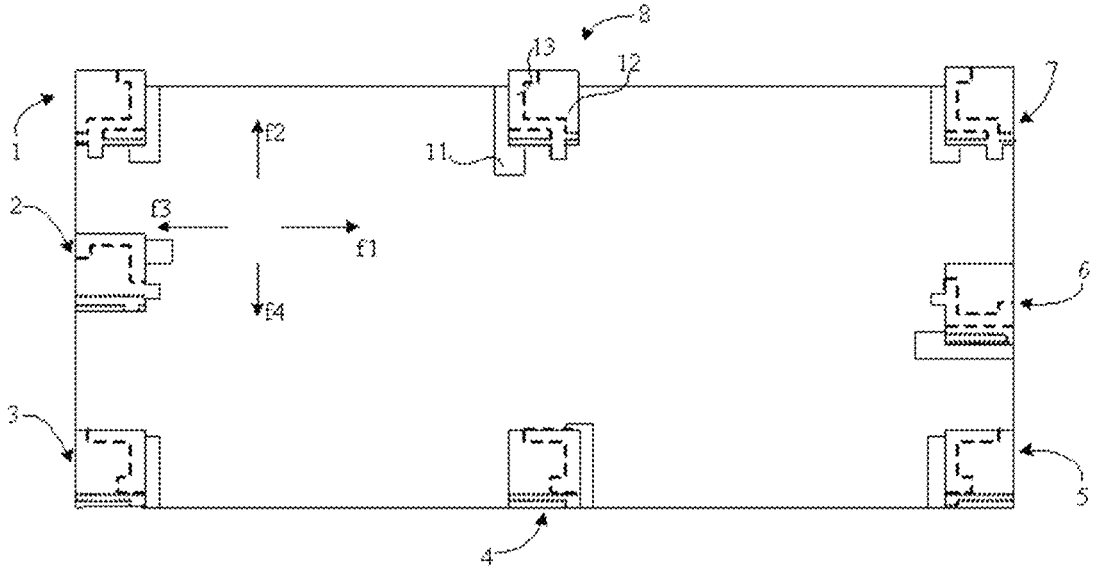
FIG. 23 is a schematic diagram of an arrangement manner of eight antenna modules shown in FIG. 10 according to an embodiment of this application.

In an embodiment of this application, referring to FIG. 23, when there are eight antenna modules, the eight antenna modules (1 to 8) are sequentially arranged to enclose a second enclosed area, and a second side surface or a third side surface of each antenna module faces the exterior of the second enclosed area. By means of the structure, a size of an eight-unit MIMO antenna can be reduced to the greatest extent, thereby improving compactness of the eight-unit MIMO antenna, and implementing a miniaturization design of the eight-unit MIMO antenna.

The eight antenna modules (1 to 8) are sequentially arranged to enclose the second enclosed area. For example, referring to FIG. 23, the first antenna module 1 and the second antenna module 2 have a same structure and are disposed orthogonal to each other, the first antenna module 1 and the second antenna module 2 are sequentially arranged along the fourth direction f4 opposite to the second direction f2, a first side surface of the first antenna module 1 is opposite to a fourth side surface of the fourth antenna module 2, and a distance between feed points 14 of the two adjacent antenna modules is equal to ⅛ of a wavelength corresponding to a lowest band covered by the antenna module. The second antenna module 2 and the third antenna module 3 are mirror symmetric, are disposed orthogonal to each other and are sequentially arranged along the fourth direction f4, a second side surface of the second antenna module 2 is opposite to a first side surface of the third antenna module 3, and a distance between feed points 14 of the two adjacent antenna modules is equal to ⅛ of a wavelength corresponding to a lowest band covered by the antenna module. The third antenna module 3 and the fourth antenna module 4 have a same structure and are sequentially arranged along the first direction f1 perpendicular to the fourth direction f4, a fourth side surface of the third antenna module 3 is opposite to a second side surface of the fourth antenna module 4, and a distance between feed points 14 of the two adjacent antenna modules is equal to ¼ of a wavelength corresponding to a lowest band covered by the antenna module. The fourth antenna module 4 and the fifth antenna module 5 are mirror symmetric and are sequentially arranged along the first direction f1, the fourth side surface of the fourth antenna module 4 is opposite to a fourth side surface of the fifth antenna module 5, and a distance between feed points 14 of the two adjacent antenna modules is equal to ¼ of a wavelength corresponding to a lowest band covered by the antenna module. The sixth antenna module 6 and the second antenna module 2 are centrosymmetric, the sixth antenna module 6 and the fifth antenna module 5 have a same structure and are orthogonal to each other, and a distance between feed points 14 of the two adjacent antenna modules is equal to ⅛ of a wavelength corresponding to a lowest band covered by the antenna module. The seventh antenna module 7 and the sixth antenna module 6 are mirror symmetric and are orthogonal to each other, and a distance between feed points 14 of the two adjacent antenna modules is equal to ⅛ of a wavelength corresponding to a lowest band covered by the antenna module. The eighth antenna module 8 and the fourth antenna module 4 have a same structure and have reverse feed directions and are sequentially arranged along the fourth direction f4, and a distance between feed points 14 of the two adjacent antenna modules is equal to ¼ of a wavelength corresponding to a lowest band covered by the antenna module. The third side surfaces of the eight antenna modules all face the exterior of the second enclosed area.

A size of the ground plate 100 is not limited. In an embodiment of this application, the second side surfaces or the third side surfaces of the eight antenna modules are disposed close to edges of the ground plate 100. By means of the structure, the size of the MIMO antenna can be reduced to the greatest extent, thereby increasing space occupied by the MIMO antenna in the terminal. A requirement for miniaturization of the terminal is met when there are a particular quantity of antenna modules, thereby improving the performance of the terminal.

According to a third aspect, an embodiment of this application provides a terminal, including: a MIMO antenna, and a radio frequency end disposed on a printed circuit board. Each feed point of the MIMO antenna is connected to the radio frequency end, and the radio frequency end is configured to send a signal to the MIMO antenna, or receive a signal sent by the MIMO antenna.

Referring to FIG. 13, the MIMO antenna includes a ground plate 100, and at least two antenna modules disposed on the ground plate 100.

Each antenna module includes a clearance area 11, a support 12, and at least two branches 13.

Each branch 13 is disposed on the support 12. A partial projection of the support 12 on a horizontal plane falls within the clearance area 11. A projection, on the horizontal plane, of one end that is of each branch 13 and that is configured to connect to a feed point is outside the clearance area 11, and a projection of a tail end on the horizontal plane is inside the clearance area 11.

This embodiment of this application provides the terminal. The at least two branches 13 are disposed on the support 12, and the support 12 is placed on the clearance area 11, so that the partial projection of the support 12 on the horizontal plane is inside the clearance area 11, the projection, on the horizontal plane, of the end that is of each of the at least two branches 13 and that is connected to the feed point is outside the clearance area 11, and the projection of the tail end on the horizontal plane is inside the clearance area 11. In this way, the clearance area can be properly used, and a size of the clearance area can be reduced, thereby implementing miniaturization of the antenna module. Furthermore, the tail end of the branch 13 is disposed inside the clearance area 11, to complete resonance, so that surface currents on the branch 13 are centralized on an edge of the clearance area 11 as many as possible, and currents distributed on a ground plate are reduced. In addition, the at least two branches can resonate in different bands, so that the antenna module can operate in a plurality of bands. Therefore, the antenna module can operate at a plurality of frequencies, and a size of the antenna module can be reduced, thereby implementing the miniaturization of the antenna module. When the antenna module is applied to the MIMO antenna, a size of the MIMO antenna can be reduced. When the MIMO antenna is applied to the terminal, a requirement for miniaturization of the terminal can be met.

The terminal is not limited, and the terminal may be a mobile phone or a computer.

It should be noted that, when the MIMO antenna is applied to the terminal, the MIMO antenna may be a two-unit MIMO antenna, may be a four-unit MIMO antenna, or may be an eight-unit MIMO antenna.

A structure of each antenna module is not limited.

In an embodiment of this application, referring to FIG. 2, the clearance area 11 includes a first side edge a and a second side edge b that are adjacent to each other, and a third side edge c and a fourth side edge d that are disposed respectively opposite to the first side edge a and the second side edge b. The support 12 includes a first side surface and a second side surface that are adjacent to each other, and a third side surface and a fourth side surface that are respectively opposite to the first side surface and the second side surface. A projection of the second side surface of the support 12 on the horizontal plane falls on a straight line of the second side edge b of the clearance area 11, and coincides with at least a part of the second side edge b of the clearance area 11. A distance between a projection of the support 12 on the horizontal plane and each of the third side edge c and the fourth side edge d of the clearance area 11 is 0 mm to 5 mm. The first side surface of the support 12 is outside the clearance area 11.

The clearance area 11 and the support 12 are arranged in the foregoing location relationship, so that the size of the clearance area 11 can be reduced to the greatest extent, thereby reducing the size of the antenna module to the greatest extent.

In an embodiment of this application, referring to FIG. 3 and FIG. 5, the at least two branches 13 include a first feed branch 131 and a second feed branch 132; and the antenna module further includes the feed point 14 and a ground point 15. One end O that is of the first feed branch 131 and that is configured to connect to the feed point 14 is disposed on the first side surface of the support 12, and extends to the second side surface of the support 12 along the first side surface of the support 12. The ground point 15 is connected to the first feed branch 131 on the first side surface of the support 12. One end P that is of the second feed branch 132 and that is configured to connect to the feed point 14 is connected to the first feed branch 131 on the first side surface of the support 12, and extends to an upper surface of the support 12 along the first side surface of the support 12. A length of the first feed branch 131 is ¼ of a wavelength corresponding to a first preset band, and a length of the second feed branch 132 is ⅛ of a wavelength corresponding to a second preset band.

The two feed branches (131 and 132) are disposed on the support 12, and locations and the lengths of the two feed branches (131 and 132) are adjusted, so that the antenna module operates in the first preset band and the second preset band. In addition, because of relative location relationships between the two feed branches (131 and 132) and the clearance area 11, the surface currents on the two feed branches (131 and 132) are centralized on the edge of the clearance area 11, and the currents distributed on the ground plate can be reduced, thereby reducing current coupling between the antenna modules. Further, the two feed branches (131 and 132) are respectively disposed on a side surface and the upper surface of the support 12, to reduce a size of the support 12 as much as possible while ensuring that the two feed branches (131 and 132) independently operate, thereby further reducing the size of the antenna module.

A connection between the ground point 15 and the first feed branch 131 on the first side surface of the support 12 is not limited. The ground point 15 may be connected, by using a ground branch, to the end that is of the first feed branch 131 and that is configured to connect to the feed point 14, or the ground point 15 may be directly disposed on the first feed branch 131 on the first side surface of the support 12. Referring to FIG. 3 and FIG. 5, when the ground point 15 is connected, by using the ground branch, to the end that is of the first feed branch 131 and that is configured to connect to the feed point 14, the length of the first feed branch 131 is equal to a sum of a length of the ground branch and a length from the end connected to the feed point to the tail end of the first feed branch 131. When the ground point 15 is directly disposed on the first feed branch 131 on the first side surface of the support 12 (not shown), the length of the first branch 131 is a length from the end that is of the first branch 131 and that is configured to connect to the feed point 14 to the tail end of the first branch 131.

The first preset band and the second preset band are not limited. Relative location relationships between the support 12 and the first feed branch 131 and the second feed branch 132 may be adjusted, so that the first feed branch 131 and the second feed branch 132 independently operate, and resonate in required different bands.

A band of PCS 1880 MHz to 1920 MHz and a band of ITE 2300 MHz to 2700 MHz are most frequently used bands. Therefore, in this embodiment of this application, a relative location relationship between the support 12 and each branch 13 is adjusted, and the first band and the second band may be any two medium or high bands in the band of PCS 1880 MHz to 1920 MHz and the band of ITE 2300 MHz to 2700 MHz.

In an embodiment of this application, the first preset band is ITE 2300 MHz, and the second preset band is 2700 MHz.

In another embodiment of this application, referring to FIG. 4 and FIG. 6, the at least two branches 13 further include a parasitic branch 133. The parasitic branch 133 is disposed inside the clearance area 11, and one end Q of the parasitic branch 133 is connected to the first side edge a of the clearance area 11; and a length of the parasitic branch 133 is 1/10 of a wavelength corresponding to a third preset band.

In this embodiment of this application, the parasitic branch 133 is added, and a location and the length of the parasitic branch 133 are adjusted, so that the parasitic branch 133 resonates in the third preset band, and the antenna module operates in three bands, thereby improving performance of the antenna module.

In an embodiment of this application, the third preset band is PCS 1880 MHz. The band of PCS 1880 MHz to 1920 MHz and the band of ITE 2300 MHz to 2700 MHz are most frequently used bands in wireless communications. Therefore, the antenna module can operate in the most frequently used bands, thereby improving the performance of the antenna module. In addition, because of corresponding location relationships between the three branches (131, 132, and 133) and the clearance area 11, the surface currents on the three branches (131, 132, and 133) can be centralized on the edge of the clearance area 11, and the currents distributed on the ground plate can be reduced. When the antenna module is applied to the MIMO antenna, the size of the MIMO antenna can be reduced to the greatest extent, and current coupling in the MIMO antenna can be reduced, thereby improving performance of the MIMO antenna.

During actual application, a distance between the antenna modules in the MIMO antenna is ½ of a wavelength corresponding to a band covered by the antenna module. In this case, a relative location relationship between any two adjacent antenna modules is not limited.

In an embodiment of this application, the at least two antenna modules include a first antenna module 1 and a second antenna module 2. The first antenna module 1 and the second antenna module 2 are any two adjacent antenna modules. Referring to FIG. 13, if the first antenna module 1 and the second antenna module 2 have a same structure, the first antenna module 1 and the second antenna module 2 are sequentially arranged in a staggered manner in a first direction f1 and a second direction f2, a second side surface of the first antenna module 1 faces a third direction f3 opposite to the first direction f1, and a second side surface of the second antenna module 2 faces the second direction f2, a distance between feed points 14 of the two adjacent antenna modules is greater than or equal to ¼ of a wavelength corresponding to a lowest band covered by the antenna module; or (not shown), if the first antenna module 1 and the second antenna module 2 are mirror symmetric, the first antenna module 1 and the second antenna module 2 are sequentially arranged in a staggered manner in a first direction f1 and a second direction f2, a second side surface of the first antenna module 1 faces a third direction f3 opposite to the first direction f1, and a second side surface of the second antenna module 2 faces the second direction f2, a distance between feed points 14 of the two adjacent antenna modules is greater than or equal to ¼ of a wavelength corresponding to a lowest band covered by the antenna module. Referring to FIG. 14, if the first antenna module 1 and the second antenna module 2 are mirror symmetric and have reverse feed directions, a distance between feed points 14 of the two adjacent antenna modules is greater than or equal to ⅛ of a wavelength corresponding to a lowest band covered by the antenna module. Referring to FIG. 15, if the first antenna module 1 and the second antenna module 2 are mirror symmetric and have opposite feed directions, a distance between feed points 14 of the two adjacent antenna modules is greater than or equal to ¼ of a wavelength corresponding to a lowest band covered by the antenna module. Referring to FIG. 16, if the first antenna module 1 and the second antenna module 2 are mirror symmetric and have a same feed direction, and fourth side surfaces of the two adjacent antenna modules are disposed opposite to each other, a distance between feed points 14 of the two adjacent antenna modules is greater than or equal to ¼ of a wavelength corresponding to a lowest band covered by the antenna module.

In this embodiment of this application, the any two adjacent antenna modules are arranged in the foregoing manner, so that a distance between the antenna modules can be reduced while ensuring normal operation of the antenna module, thereby reducing the size of the MIMO antenna when the MIMO antenna is formed by using a same quantity of antenna modules.

A quantity of antenna modules is not limited, and a maximum quantity of antenna modules can be accommodated based on a size of an application terminal, thereby improving performance of the application terminal.

In an embodiment of this application, there are two to eight antenna modules.

It should be noted that, when there are two antenna modules, a location relationship between the two antenna modules satisfies any one of the foregoing five cases. When there are three antenna modules, referring to FIG. 17, a location relationship between any two (herein, using a first antenna module 1 and a second antenna module 2 as an example) of the three antenna modules satisfies any one of the foregoing five cases, a location relationship between the other antenna module (using a third antenna module 3 as an example) and the first antenna module 1 satisfies any one of the foregoing five cases, and a location relationship between the third antenna module 3 and the second antenna module 2 also satisfies any one of the foregoing five cases. Similarly, when there are four antenna modules, a location relationship between any two (herein, using a first antenna module 1 and a second antenna module 2 as an example) of the four antenna modules satisfies any one of the foregoing five cases, a location relationship between one (using a third antenna module 3 as an example) of the other two antenna modules (using the third antenna module 3 and a fourth antenna module 4 as an example) and the first antenna module 1 satisfies any one of the foregoing five cases, a location relationship between the third antenna module 3 and the second antenna module 2 also satisfies any one of the foregoing five cases, a location relationship between the fourth antenna module 4 and the first antenna module 1 satisfies any one of the foregoing five cases, a location relationship between the fourth antenna module 4 and the second antenna module 2 also satisfies any one of the foregoing five cases, and a location relationship between the fourth antenna module 4 and the third antenna module 3 also satisfies any one of the foregoing five cases. When there are five, six, seven, or eight antenna modules, the antenna modules are disposed according to the foregoing rule, and details are not described herein.

In an embodiment of this application, referring to FIG. 17, when there are eight antenna modules, the eight antenna modules (1 to 8) are sequentially arranged to enclose a first enclosed area, and a second side surface of each antenna module faces the exterior of the first enclosed area. By means of the structure, a size of an eight-unit MIMO antenna can be reduced to the greatest extent, thereby improving compactness of the eight-unit MIMO antenna, and implementing a miniaturization design of the eight-unit MIMO antenna.

The eight antenna modules (1 to 8) are sequentially arranged to enclose the first enclosed area. For example, referring to FIG. 17, the first antenna module 1 and the second antenna module 2 have a same structure, the first antenna module 1 and the second antenna module 2 are sequentially arranged in a staggered manner in the first direction f1 and the second direction f2, a second side surface of the first antenna module 1 faces the third direction f3 opposite to the first direction f1, a second side surface of the second antenna module 2 faces the second direction f2, and a distance between feed points 14 of the two adjacent antenna modules is equal to ¼ of a wavelength corresponding to a lowest band covered by the antenna module. The second antenna module 2 and the third antenna module 3 are mirror symmetric and have opposite feed directions, and a distance between feed points 14 of the two adjacent antenna modules is equal to ¼ of a wavelength corresponding to a lowest band covered by the antenna module. The third antenna module 3 and the fourth antenna module 4 have a same structure, a location relationship between the fourth antenna module 4 and the third antenna module 3 and a location relationship between the first antenna module 1 and the second antenna module 2 are in a one-to-one correspondence and are mirror symmetric. The fourth antenna module 4 and the fifth antenna module 5 are mirror symmetric and have reverse feed directions, and a distance between feed points 14 of the two adjacent antenna modules is equal to ⅛ of a wavelength corresponding to a lowest band covered by the antenna module. A location relationship between the sixth antenna module 6 and the fifth antenna module 5 and the location relationship between the third antenna module 3 and the fourth antenna module are in a one-to-one correspondence and are mirror symmetric. The seventh antenna module 7 and the sixth antenna module 6 are mirror symmetric and have opposite feed directions, and a distance between feed points 14 of the sixth antenna module 6 and the seventh antenna module 7 is equal to ¼ of a wavelength corresponding to a lowest band covered by the antenna module. A location relationship between the eighth antenna module 8 and the seventh antenna module 7 and a location relationship between the first antenna module 1 and the second antenna module 2 are in a one-to-one correspondence and are mirror symmetric. The second side surfaces of the eight antenna modules all face the exterior of the first enclosed area.

Using an example in which the eight-unit MIMO antenna operates in the most frequently used operating bands of 1880 MHz to 1920 MHz and 2300 MHz to 2700 MHz, when the eight-unit MIMO antenna is arranged as shown in FIG. 17, a wavelength corresponding to a lowest operating band of the antenna module is 15 cm. In this case, the size of the terminal may be that a length is approximately 7 cm to 15 cm, and a width is approximately 6 cm to 10 cm. Therefore, when the eight-unit MIMO antenna is applied to the terminal, the size of the terminal is equal to a size of a mobile phone, and the eight-unit MIMO antenna may be applied to the mobile phone. Therefore, the size of the terminal can be reduced to the greatest extent, and a system throughput rate of the terminal can be improved during operation.

In an embodiment of this application, referring to FIG. 7 and FIG. 8, the clearance area 11 includes a first area 111 and a second area 112 that are orthogonal to each other. The first area 111 includes a side edge-I i and a side edge-II m that are adjacent to each other, and a side edge-III n and a side edge-IV o that are disposed respectively opposite to the side edge-I i and the side edge-II m. The second area 112 is a structure that extends out along a length direction of the side edge-II m of the first area 111. The support 12 includes a first side surface and a second side surface that are adjacent to each other, and a third side surface and a fourth side surface that are respectively opposite to the first side surface and the second side surface. A projection of the third side surface of the support 12 on the horizontal plane coincides with the side edge-I i of the first area 111. A projection of the second side surface of the support 12 on the horizontal plane falls on a straight line of the side edge-IV o of the first area 111, and coincides with a part of the side edge-IV o of the first area 111. A distance between a projection of the support 12 on the horizontal plane and each of the side edge-II m of the first area 111 and a side edge e that is of the second area 112 and that is far away from the first area 111 is 0 mm to 5 mm. A partial projection of the first side surface of the support 12 on the horizontal plane is outside the clearance area 11.

The clearance area 11 and the support 12 are arranged in the foregoing location relationship, so that the size of the clearance area 11 can be reduced to the greatest extent, thereby reducing the size of the antenna module to the greatest extent.

In an embodiment of this application, referring to FIG. 9 and FIG. 11, the at least two branches 13 include a feed branch-I 134 and a feed branch-II 135, and the antenna module further includes the feed point 14 and a ground point 15. One end L that is of the feed branch-I 134 and that is configured to connect to the feed point 14 is connected to the feed point 14. A first end of the feed branch-I 134 is disposed on the first side surface of the support 12, and extends to the second side surface of the support 12 along the first side surface of the support 12. The ground point 15 is disposed on the feed branch-I 134 on the second side surface of the support 12. One end M that is of the feed branch-II 135 and that is configured to connect to the feed point is connected to the feed branch-I 134 on the first side surface of the support 12, and extends to an upper surface of the support 12 along the first side surface of the support 12. A length of the feed branch-I 134 is ¼ of a wavelength corresponding to a first preset band, and a length of the feed branch-II 135 is ⅛ of a wavelength corresponding to a second preset band.

The two feed branches (134 and 135) are disposed on the support 12, and locations and the lengths of the two feed branches (134 and 135) are adjusted, so that the antenna module operates in the first preset band and the second preset band. In addition, because of relative location relationships between the two feed branches (134 and 135) and the clearance area 11, the surface currents on the two feed branches (134 and 135) are centralized on the edge of the clearance area 11, and the currents distributed on the ground plate can be reduced, thereby reducing current coupling between the antenna modules. Further, the two feed branches (134 and 135) are respectively disposed on a side surface and the upper surface of the support 12, to reduce a size of the support 12 as much as possible while ensuring that the two feed branches (134 and 135) independently operate, thereby further reducing the size of the antenna module.

The first preset band and the second preset band are not limited. Relative location relationships between the support 12 and the feed branch-I 134 and the feed branch-II 135 may be adjusted, so that the feed branch-I 134 and the feed branch-II 135 independently operate, and resonate in required different bands.

A band of PCS 1880 MHz to 1920 MHz and a band of ITE 2300 MHz to 2700 MHz are most frequently used bands. Therefore, in this embodiment of this application, a relative location relationship between the support 12 and each branch 13 is adjusted, and the first band and the second band may be any two medium or high bands in the band of PCS 1880 MHz to 1920 MHz and the band of ITE 2300 MHz to 2700 MHz.

In an embodiment of this application, the first preset band is ITE 2300 MHz, and the second preset band is 2700 MHz.

In another embodiment of this application, referring to FIG. 10 and FIG. 12, the at least two branches further include a feed branch-III 136. One end N that is of the feed branch-III 136 and that is configured to connect to the feed point 14 is connected to the feed branch-II 135 on the first side surface of the support 12, and extends to the fourth side surface of the support 12 along the first side surface of the support 12. A length of the feed branch-III 136 is 1/10 of a wavelength corresponding to a third preset band.

In this embodiment of this application, the feed branch-III 136 is added, and a location and the length of the feed branch-III 136 are adjusted, so that the feed branch-III 136 resonates in the third preset band, and the antenna module operates in three bands, thereby improving performance of the antenna module.

In an embodiment of this application, the third preset band is PCS 1880 MHz. The band of PCS 1880 MHz to 1920 MHz and the band of ITE 2300 MHz to 2700 MHz are most frequently used bands in wireless communications. Therefore, the antenna module can operate in the most frequently used bands, thereby improving the performance of the antenna module. In addition, because of corresponding location relationships between the three branches (134, 135, and 136) and the clearance area 11, the surface currents on the three branches (134, 135, and 136) can be centralized on the edge of the clearance area 11, and the currents distributed on the ground plate can be reduced. When the antenna module is applied to the MIMO antenna, the size of the MIMO antenna can be reduced to the greatest extent, and current coupling in the MIMO antenna can be reduced, thereby improving performance of the MIMO antenna.

During actual application, a distance between the antenna modules in the MIMO antenna is ½ of a wavelength corresponding to a band covered by the antenna module. In this case, a relative location relationship between any two adjacent antenna modules is not limited.

In an embodiment of this application, the at least two antenna modules include a third antenna module 3 and a fourth antenna module 4. The third antenna module 3 and the fourth antenna module 4 are any two adjacent antenna modules. Referring to FIG. 18, if the third antenna module 3 and the fourth antenna module 4 have a same structure and are disposed orthogonal to each other, the third antenna module 3 and the fourth antenna module 4 are sequentially arranged along a fourth direction f4 opposite to a second direction f2, and a first side surface of the third antenna module 3 is opposite to a fourth side surface of the fourth antenna module 4, a distance between feed points 14 of the two adjacent antenna modules is greater than or equal to ⅛ of a wavelength corresponding to a lowest band covered by the antenna module. Referring to FIG. 20, if the third antenna module 3 and the fourth antenna module 4 have a same structure and are sequentially arranged along a first direction f1 perpendicular to a fourth direction f4, and a fourth side surface of the third antenna module 3 is opposite to a first side surface or a second side surface of the fourth antenna module 4, a distance between feed points 14 of the two adjacent antenna modules is greater than or equal to ¼ of a wavelength corresponding to a lowest band covered by the antenna module. Referring to FIG. 21, if the third antenna module 3 and the fourth antenna module 4 have a same structure and have reverse feed directions and are sequentially arranged along a fourth direction f4, a distance between feed points 14 of the two adjacent antenna modules is greater than or equal to ¼ of a wavelength corresponding to a lowest band covered by the antenna module. Referring to FIG. 22, if the third antenna module 3 and the fourth antenna module 4 are mirror symmetric, are disposed orthogonal to each other and are sequentially arranged along a fourth direction f4, and a second side surface of the third antenna module 3 is opposite to a first side surface of the fourth antenna module 4, a distance between feed points 14 of the two adjacent antenna modules is greater than or equal to ⅛ of a wavelength corresponding to a lowest band covered by the antenna module. Referring to FIG. 19, if the third antenna module 3 and the fourth antenna module 4 are mirror symmetric and are sequentially arranged along a first direction f1, and a fourth side surface of the third antenna module 3 is opposite to a third side surface or a fourth side surface of the fourth antenna module 4, a distance between feed points 14 of the two adjacent antenna modules is greater than or equal to ¼ of a wavelength corresponding to a lowest band covered by the antenna module.

In this embodiment of this application, the any two adjacent antenna modules are arranged in the foregoing manner, so that a distance between the antenna modules can be reduced while ensuring isolation of the antenna modules, thereby reducing the size of the MIMO antenna when the MIMO antenna is formed by using a same quantity of antenna modules.

A quantity of antenna modules is not limited, and a maximum quantity of antenna modules can be accommodated based on a size of an application terminal, thereby improving performance of the application terminal.

In an embodiment of this application, there are two to eight antenna modules.

It should be noted that, when there are two antenna modules, a location relationship between the two antenna modules satisfies any one of the foregoing five cases. When there are three antenna modules, referring to FIG. 23, a location relationship between any two (herein, using a first antenna module 1 and a second antenna module 2 as an example) of the three antenna modules satisfies any one of the foregoing five cases, a location relationship between the other antenna module (using a third antenna module 3 as an example) and the first antenna module 1 satisfies any one of the foregoing five cases, and a location relationship between the third antenna module 3 and the second antenna module 2 also satisfies any one of the foregoing five cases. Similarly, when there are four antenna modules, a location relationship between any two (herein, using a first antenna module 1 and a second antenna module 2 as an example) of the four antenna modules satisfies any one of the foregoing five cases, a location relationship between one (using a third antenna module 3 as an example) of the other two antenna modules (using the third antenna module 3 and a fourth antenna module 4 as an example) and the first antenna module 1 satisfies any one of the foregoing five cases, a location relationship between the third antenna module 3 and the second antenna module 2 also satisfies any one of the foregoing five cases, a location relationship between the fourth antenna module 4 and the first antenna module 1 satisfies any one of the foregoing five cases, a location relationship between the fourth antenna module 4 and the second antenna module 2 also satisfies any one of the foregoing five cases, and a location relationship between the fourth antenna module 4 and the third antenna module 3 also satisfies any one of the foregoing five cases. When there are five, six, seven, or eight antenna modules, the antenna modules are disposed according to the foregoing rule, and details are not described herein.

In an embodiment of this application, referring to FIG. 23, when there are eight antenna modules, the eight antenna modules (1 to 8) are sequentially arranged to enclose a second enclosed area, and a second side surface or a third side surface of each antenna module faces the exterior of the second enclosed area. By means of the structure, the size of the eight-unit MIMO antenna can be reduced to the greatest extent, thereby improving compactness of the eight-unit MIMO antenna, and implementing a miniaturization design of the eight-unit MIMO antenna.

The eight antenna modules (1 to 8) are sequentially arranged to enclose the second enclosed area. For example, referring to FIG. 23, the first antenna module 1 and the second antenna module 2 have a same structure and are disposed orthogonal to each other, the first antenna module 1 and the second antenna module 2 are sequentially arranged along the fourth direction f4 opposite to the second direction f2, a first side surface of the first antenna module 1 is opposite to a fourth side surface of the fourth antenna module 2, and a distance between feed points 14 of the two adjacent antenna modules is equal to ⅛ of a wavelength corresponding to a lowest band covered by the antenna module. The second antenna module 2 and the third antenna module 3 are mirror symmetric, are disposed orthogonal to each other and are sequentially arranged along the fourth direction f4, a second side surface of the second antenna module 2 is opposite to a first side surface of the third antenna module 3, and a distance between feed points 14 of the two adjacent antenna modules is equal to ⅛ of a wavelength corresponding to a lowest band covered by the antenna module. The third antenna module 3 and the fourth antenna module 4 have a same structure and are sequentially arranged along the first direction f1 perpendicular to the fourth direction f4, a fourth side surface of the third antenna module 3 is opposite to a second side surface of the fourth antenna module 4, and a distance between feed points 14 of the two adjacent antenna modules is equal to ¼ of a wavelength corresponding to a lowest band covered by the antenna module. The fourth antenna module 4 and the fifth antenna module 5 are mirror symmetric and are sequentially arranged along the first direction f1, the fourth side surface of the fourth antenna module 4 is opposite to a fourth side surface of the fifth antenna module 5, and a distance between feed points 14 of the two adjacent antenna modules is equal to ¼ of a wavelength corresponding to a lowest band covered by the antenna module. The sixth antenna module 6 and the second antenna module 2 are centrosymmetric, the sixth antenna module 6 and the fifth antenna module 5 have a same structure and are orthogonal to each other, and a distance between feed points 14 of the two adjacent antenna modules is equal to ⅛ of a wavelength corresponding to a lowest band covered by the antenna module. The seventh antenna module 7 and the sixth antenna module 6 are mirror symmetric and are orthogonal to each other, and a distance between feed points 14 of the two adjacent antenna modules is equal to ⅛ of a wavelength corresponding to a lowest band covered by the antenna module. The eighth antenna module 8 and the fourth antenna module 4 have a same structure and have reverse feed directions and are sequentially arranged along the fourth direction f4, and a distance between feed points 14 of the two adjacent antenna modules is equal to ¼ of a wavelength corresponding to a lowest band covered by the antenna module. The third side surfaces of the eight antenna modules all face the exterior of the second enclosed area.

Using an example in which the eight-unit MIMO antenna operates in the most frequently used operating bands of 1880 MHz to 1920 MHz and 2300 MHz to 2700 MHz, when the eight-unit MIMO antenna is arranged as shown in FIG. 18, a wavelength corresponding to a lowest operating band of the antenna module is 15 cm. In this case, the size of the terminal is that a length is approximately 7 cm to 15 cm, and a width is approximately 6 cm to 10 cm. Therefore, when the eight-unit MIMO antenna is applied to the terminal, the size of the terminal is equal to a size of a mobile phone, and the eight-unit MIMO antenna may be applied to the mobile phone. Therefore, the size of the terminal can be reduced to the greatest extent, and a system throughput rate of the terminal can be improved during operation.

To evaluate the embodiments of this application objectively, specific implementations of this application and brought technical effects are described in detail by setting the following embodiments and experimental examples.

Embodiment 1

Eight antenna module structures shown in FIG. 4 are arranged on the ground plate 100 in the manner shown in FIG. 17. In each antenna module, referring to FIG. 4, the projection of the second side surface of the support 12 on the horizontal plane falls on the straight line of the second side edge b of the clearance area 11, and coincides with at least a part of the second side edge b of the clearance area 11, the distance between the projection of the support 12 on the horizontal plane and each of the third side edge c and the fourth side edge d of the clearance area 11 is 0 mm to 5 mm, and the first side surface of the support 12 is outside the clearance area 11.

Embodiment 2

Eight antenna modules shown in FIG. 10 are arranged on the ground plate 100 in the manner shown in FIG. 23. In each antenna module, referring to FIG. 10, the clearance area 11 includes the first area 111 and the second area 112 that are orthogonal to each other. The projection of the third side surface of the support 12 on the horizontal plane coincides with the side edge-I i of the first area 111, the projection of the second side surface of the support 12 on the horizontal plane falls on the straight line of the side edge-IV o of the first area 111, and coincides with a part of the side edge-IV o of the first area 111, the distance between the projection of the support 12 on the horizontal plane and each of the side edge-II m of the first area 111 and the side edge e that is of the second area 112 and that is far away from the first area 111 is 0 mm to 5 mm, and the partial projection of the first side surface of the support 12 on the horizontal plane is outside the clearance area 11.

Experimental Example

Figure 24:
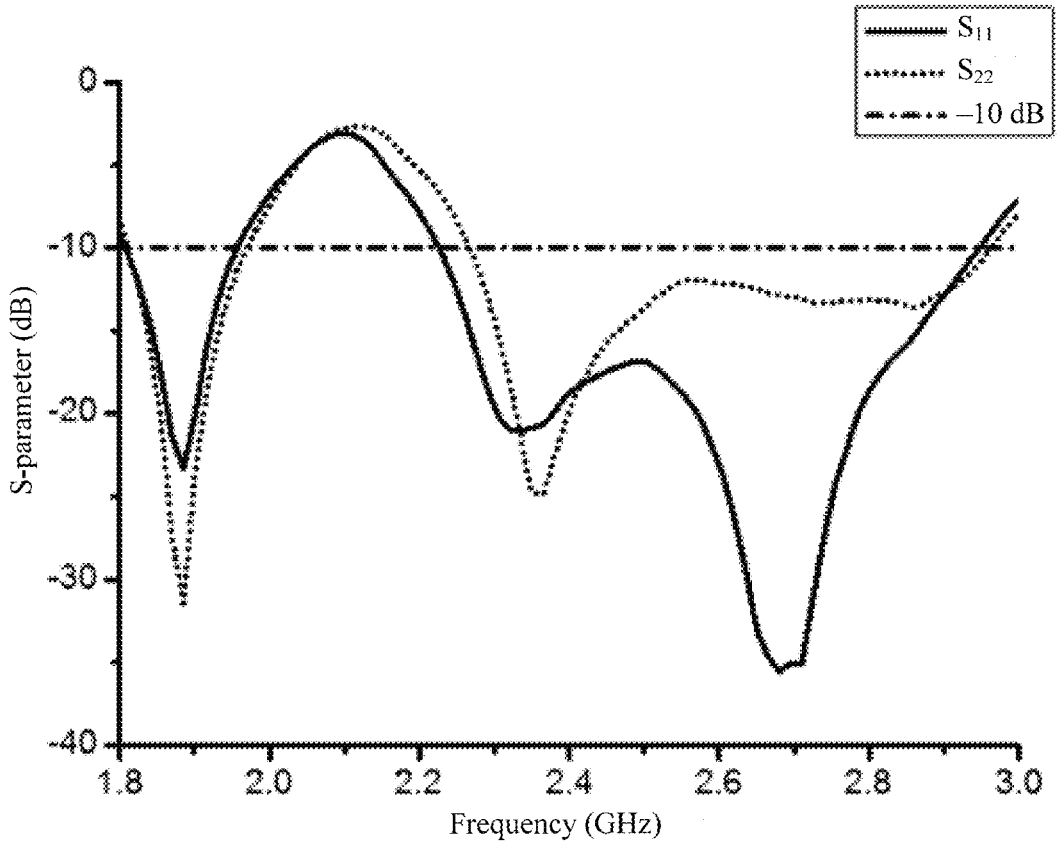
FIG. 24 is a fitted curve chart of return losses of a first antenna module 1 and a second antenna module 2 that are based on FIG. 17 according to an embodiment of this application.
Figure 25:
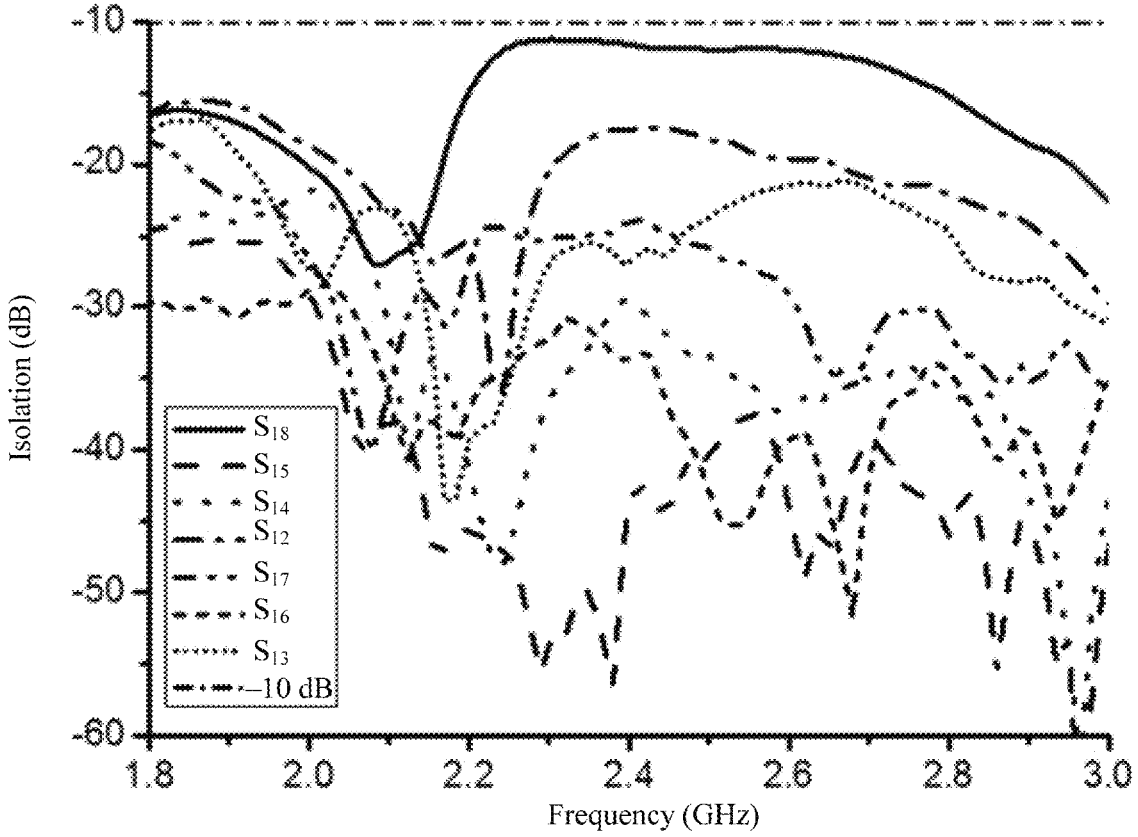
FIG. 25 is a curve chart of isolation between a first antenna module 1 and each antenna module that are based on FIG. 17 according to an embodiment of this application.

Results shown in FIG. 24 and FIG. 25 are obtained by testing a return loss and isolation of the MIMO antenna in Embodiment 1.

Referring to FIG. 24, $S_{11}$ and $S_{22}$ respectively represent return loss S-parameters of the first antenna module 1 and the second antenna module 2 in bands of 1.8 GHz to 1.9 GHz and 2.3 GHz to 2.7 GHz. It can be learned from FIG. 24 that, in the band of 1.8 GHz to 1.9 GHz, the return losses $S_{11}$ and $S_{22}$ of the first antenna module 1 and the second antenna module 2 are both less than −10 dB, and in the band of 2.3 GHz to 2.7 GHz, the return loss $S_{11}$ of the first antenna module 1 is less than −10 dB, and the return loss $S_{22}$ of the second antenna module 2 is less than −10 dB. It indicates that in the bands of 1.8 GHz to 1.92 GHz and 2.3 GHz to 2.7 GHz, the MIMO antenna can receive signals from a plurality of directions at the same time, and can also transmit signals to a plurality of directions at the same time, and can be widely applied to a plurality of wireless communications terminals.

Referring to FIG. 25, FIG. 25 is a test chart of isolation between the first antenna module 1 and other antenna modules in the bands of 1.8 GHz to 1.9 GHz and 2.3 GHz to 2.7 GHz. $S_{12}$, $S_{13}$, $S_{14}$, $S_{15}$, $S_{16}$, $S_{17}$, and $S_{18}$ are respectively isolation between the first antenna module 1 and the second antenna module 2, the third antenna module 3, the fourth antenna module 4, the fifth antenna module 5, the sixth antenna module 6, the seventh antenna module 7, and the eighth antenna module 8. It can be learned from FIG. 25 that, the isolation between the first antenna module 1 and each of the antenna modules (2 to 8) is below −10 dB, indicating that there is high isolation between the antenna modules of the MIMO antenna.

Figure 26A:
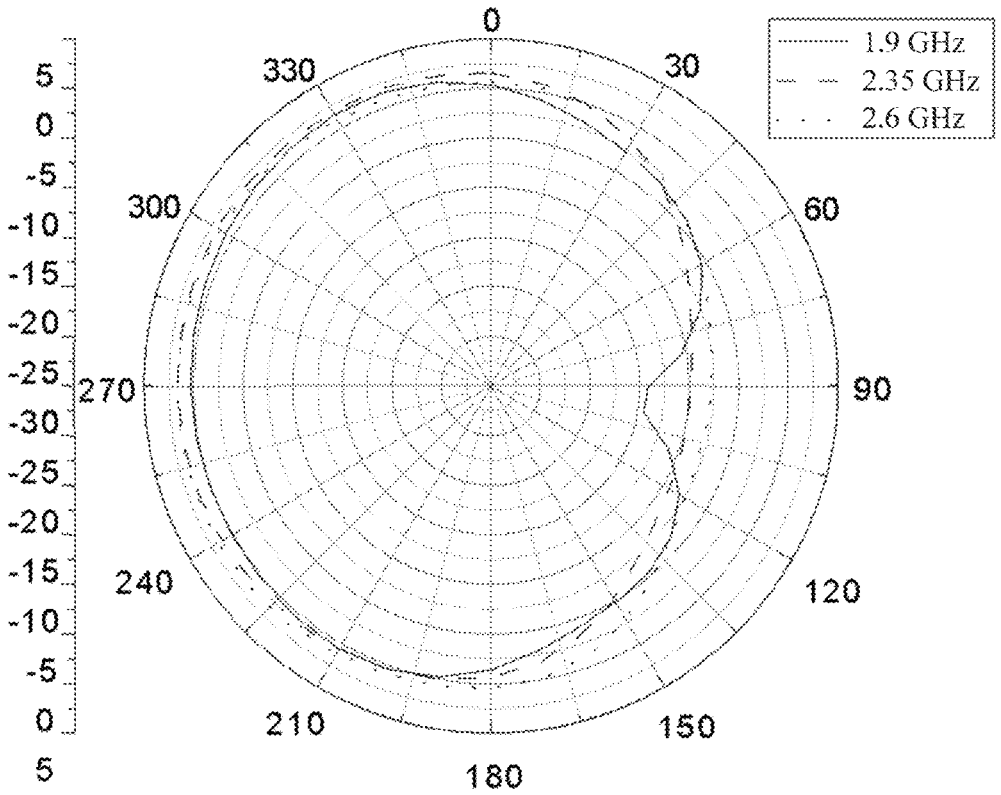
FIG. 26*a* is an antenna radiation pattern of a first antenna module 1 based on FIG. 17 according to an embodiment of this application.
Figure 26B:
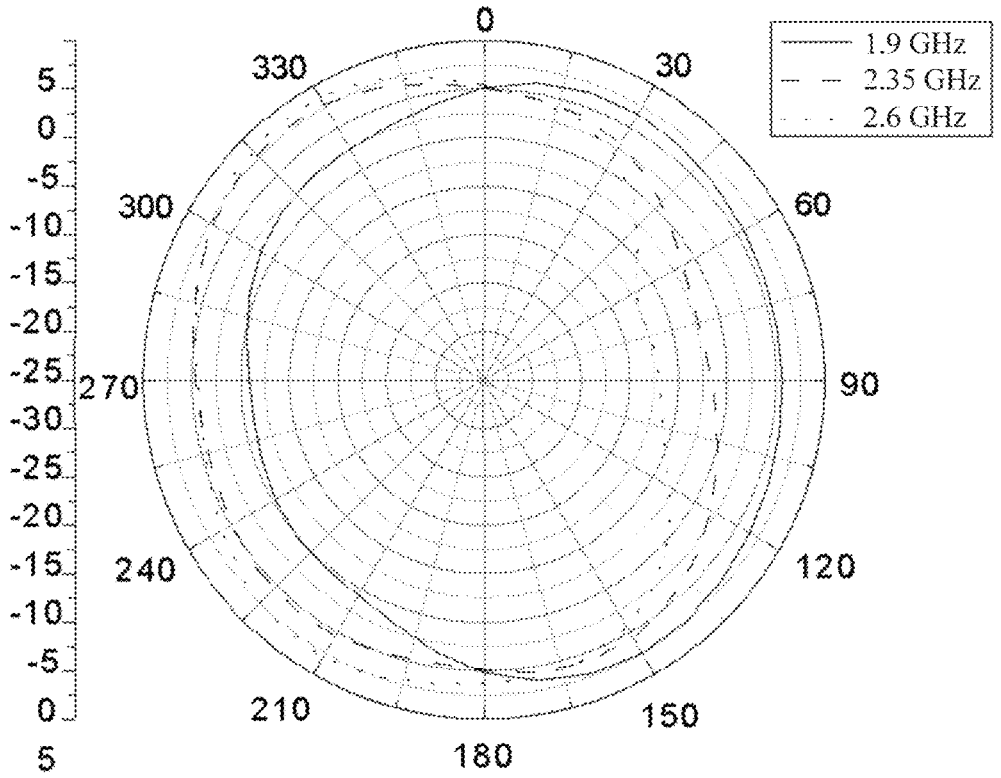
FIG. 26*b* is an antenna radiation pattern of a second antenna module 2 based on FIG. 17 according to an embodiment of this application.

Fitting is performed on a free space coupling status of the MIMO antenna in Embodiment 1, to obtain results shown in FIG. 26*a* and FIG. 26*b*.

The first antenna module 1 and the second antenna module 2 adjacent to the first antenna module 1 are used as examples to describe free space coupling statuses in bands of 1.9 GHz, 2.35 GHz, and 2.6 GHz. FIG. 26*a* is an antenna radiation pattern of the first antenna module 1, and FIG. 26*b* is an antenna radiation pattern of the second antenna module 2. It can be learned from FIG. 26*a* and FIG. 26*b* that, antenna radiation directivity of each antenna module is relatively good, and the antenna radiation patterns of the first antenna module 1 and the second antenna module 2 are oriented toward different directions. An antenna radiation pattern has particular directivity. This means that when the first antenna module 1 and the second antenna module 2 are arranged in the foregoing manner, good and high isolation is achieved between the first antenna module 1 and the second antenna module 2 during operation, and coupling between the antenna modules can be reduced, thereby ensuring operational independence of the antenna modules.

Figure 27:
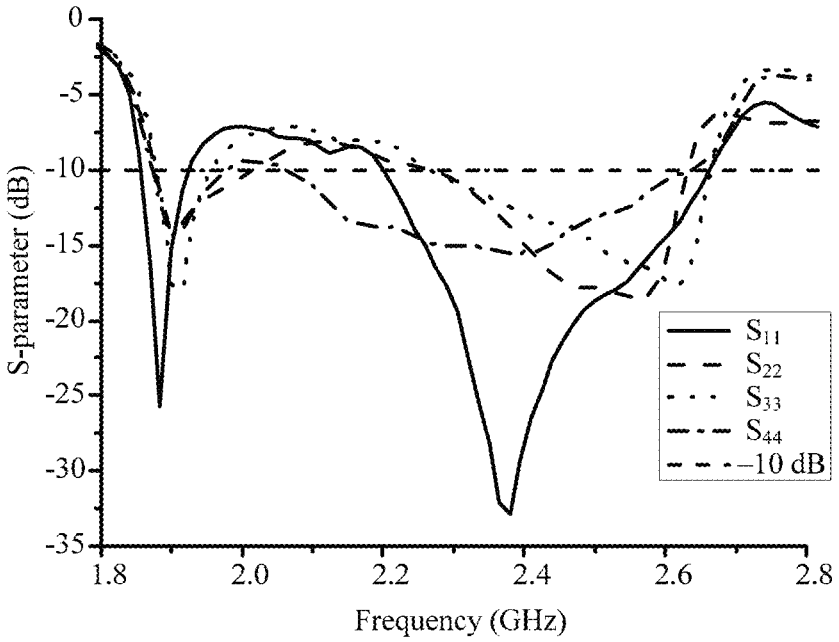
FIG. 27 is a fitted curve chart of return losses of a first antenna module 1 to a fourth antenna module 4 that are based on FIG. 23 according to an embodiment of this application.
Figure 28:
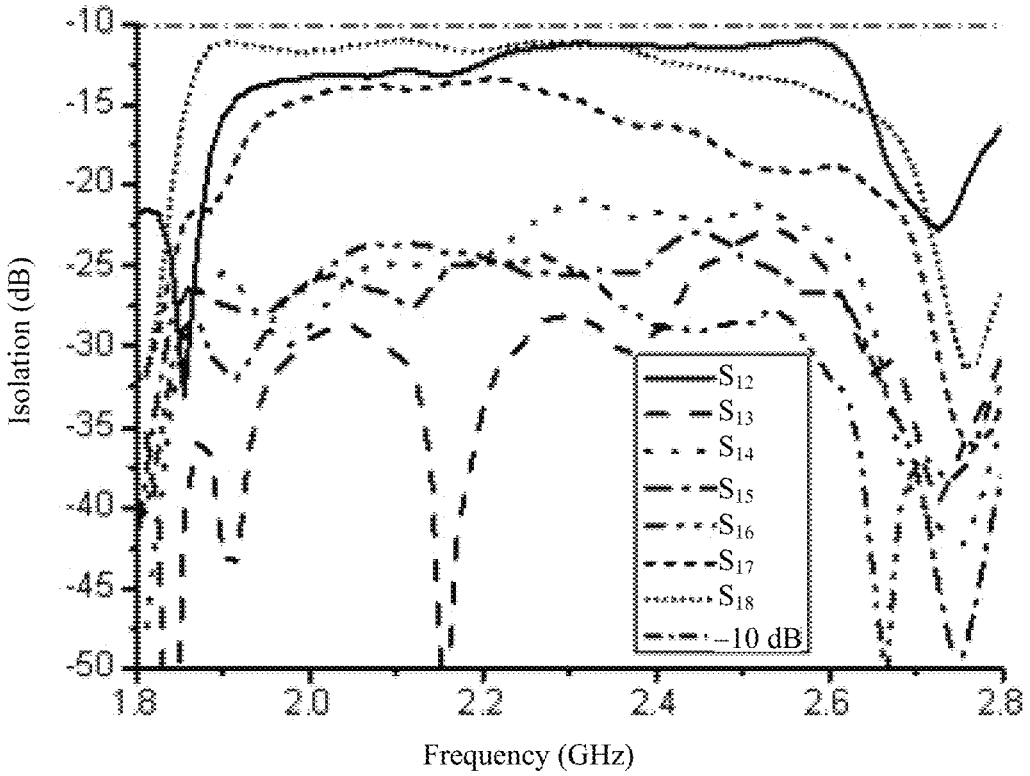
FIG. 28 is a curve chart of isolation between a first antenna module 1 and each antenna module that are based on FIG. 23 according to an embodiment of this application.

Results shown in FIG. 27 and FIG. 28 are obtained by testing a return loss and isolation of the MIMO antenna in Embodiment 2.

Referring to FIG. 27, $S_{11}$, $S_{22}$, $S_{33}$, and $S_{44}$ respectively represent return loss S-parameters of the first antenna module 1, the second antenna module 2, the third antenna module 3, and the fourth antenna module 4 in bands of 1.8 GHz to 1.9 GHz and 2.3 GHz to 2.7 GHz. It can be learned from FIG. 27 that, during operation in the band of 1.8 GHz to 1.9 GHz, the return losses $S_{11}$, $S_{22}$, $S_{33}$, and $S_{44}$ of the first antenna module 1, the second antenna module 2, the third antenna module 3, and the fourth antenna module 4 are all less than −10 dB, and during operation in the band of 2.3 GHz to 2.7 GHz, the return losses $S_{11}$, $S_{22}$, $S_{33}$, and $S_{44}$ of the first antenna module 1, the second antenna module 2, the third antenna module 3, and the fourth antenna module 4 are also all less than −10 dB. It indicates that in the bands of 1880 MHz to 1920 MHz and 2300 MHz to 2700 MHz, the antenna can receive signals from a plurality of directions at the same time, and can also transmit signals to a plurality of directions at the same time, and can be widely applied to a plurality of wireless communications terminals.

Referring to FIG. 28, FIG. 28 is a test chart of isolation between the first antenna module 1 and other antenna modules in the bands of 1.8 GHz to 1.9 GHz and 2.3 GHz to 2.7 GHz. $S_{12}$, $S_{13}$, $S_{14}$, $S_{15}$, $S_{16}$, $S_{17}$, and $S_{18}$ are respectively isolation between the first antenna module 1 and the second antenna module 2, the third antenna module 3, the fourth antenna module 4, the fifth antenna module 5, the sixth antenna module 6, the seventh antenna module 7, and the eighth antenna module 8. It can be learned from FIG. 28 that, the isolation between the first antenna module 1 and each of the antenna modules (2 to 8) is below −10 dB, indicating that there is high isolation between the antenna modules of the MIMO antenna.

Figure 29A:
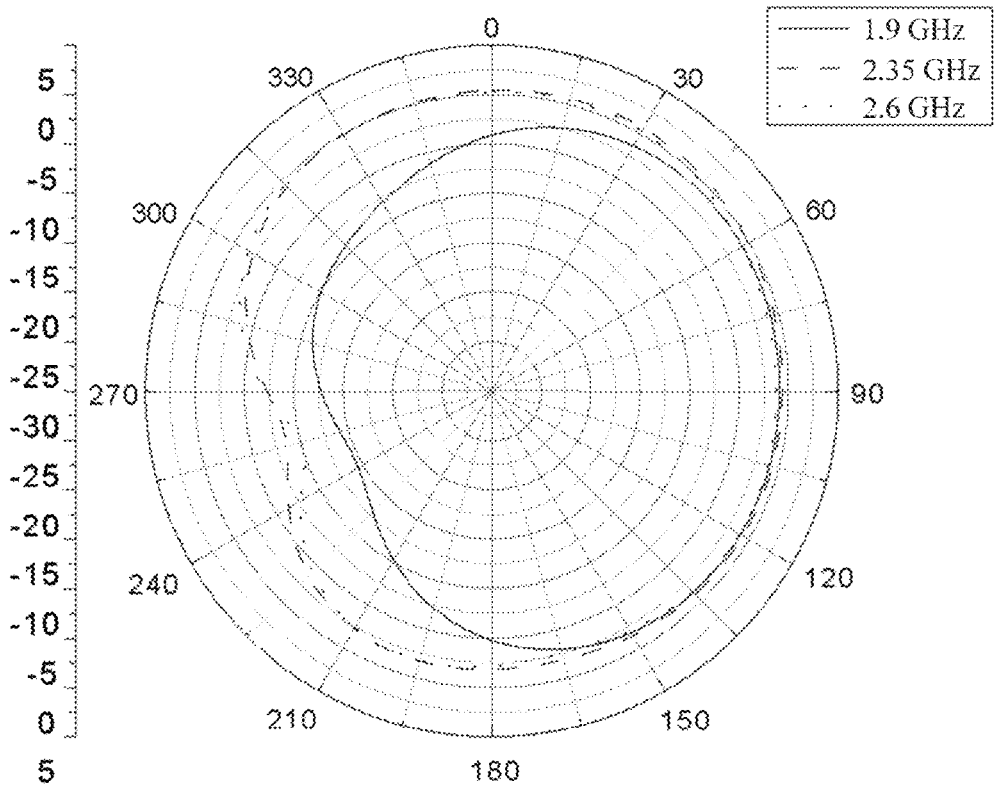
FIG. 29*a* is an antenna radiation pattern of a first antenna module 1 based on FIG. 23 according to an embodiment of this application.
Figure 29B:
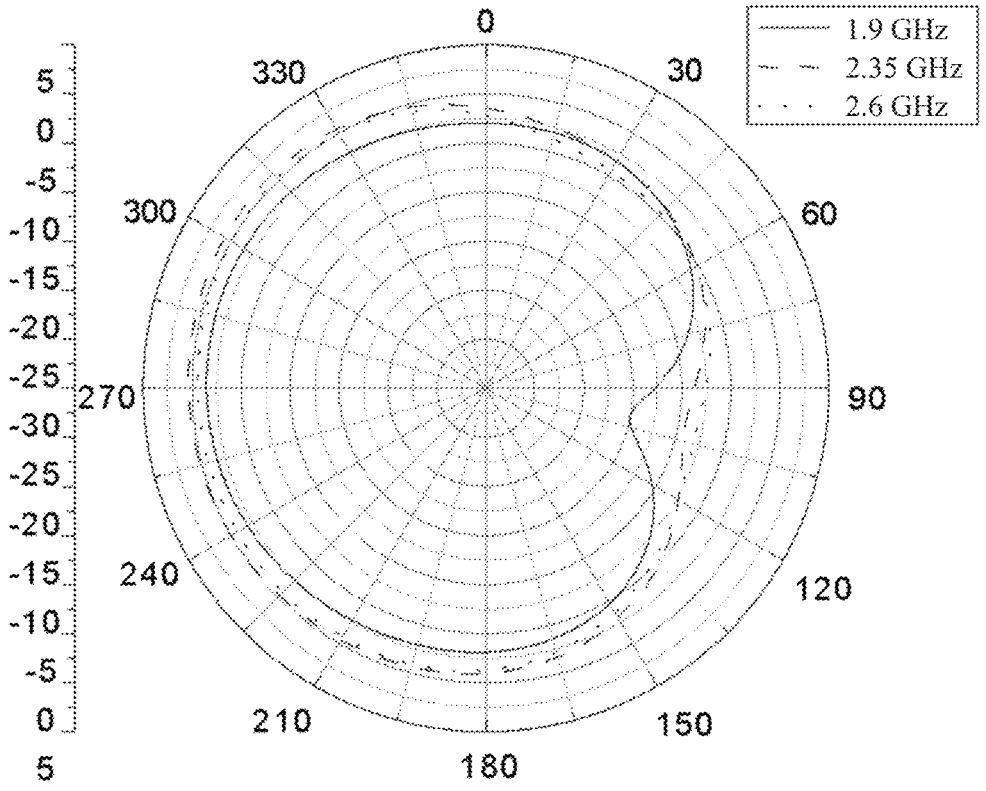
FIG. 29*b* is an antenna radiation pattern of a third antenna module 3 based on FIG. 23 according to an embodiment of this application.
Figure 29C:
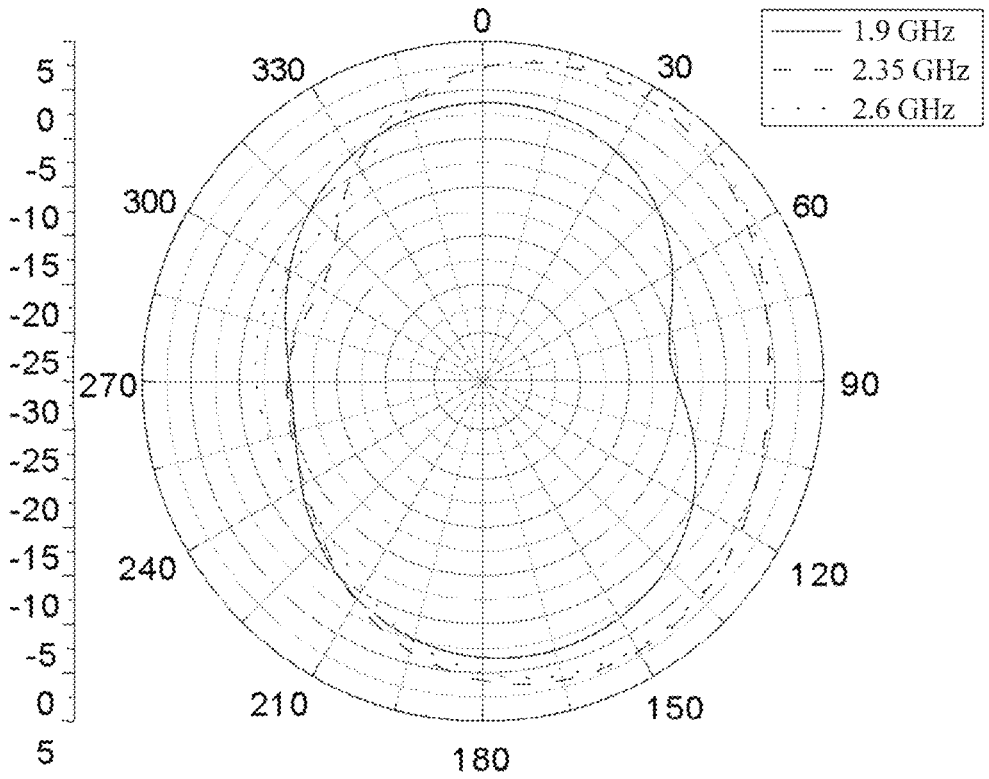
FIG. 29*c* is an antenna radiation pattern of a second antenna module 2 based on FIG. 23 according to an embodiment of this application.

Fitting is performed on a free space coupling status of the MIMO antenna in Embodiment 2, to obtain results shown in FIG. 29*a*, FIG. 29*b*, and FIG. 29*c*.

Antenna radiation patterns of the first antenna module 1, the second antenna module 2, and the third antenna module 3 in bands of 1.9 GHz, 2.35 GHz, and 2.7 GHz are used as examples to describe free space coupling statuses of the antenna modules. FIG. 29*a* is an antenna radiation pattern of the first antenna module 1, FIG. 29*b* is an antenna radiation pattern of the third antenna module 3, and FIG. 29*c* is an antenna radiation pattern of the second antenna module 2. It can be learned from FIG. 29*a*, FIG. 29*b*, and FIG. 29*c* that, the antenna radiation patterns of the first antenna module 1, the second antenna module 2, and the third antenna module 3 are oriented toward different directions. An antenna radiation pattern has particular directivity. This means that good and high isolation is achieved between the first antenna module 1, the second antenna module 2, and the third antenna module 3 during operation, and coupling between the antenna modules can be reduced, thereby improving operational independence of the antenna modules.

Figure 30:
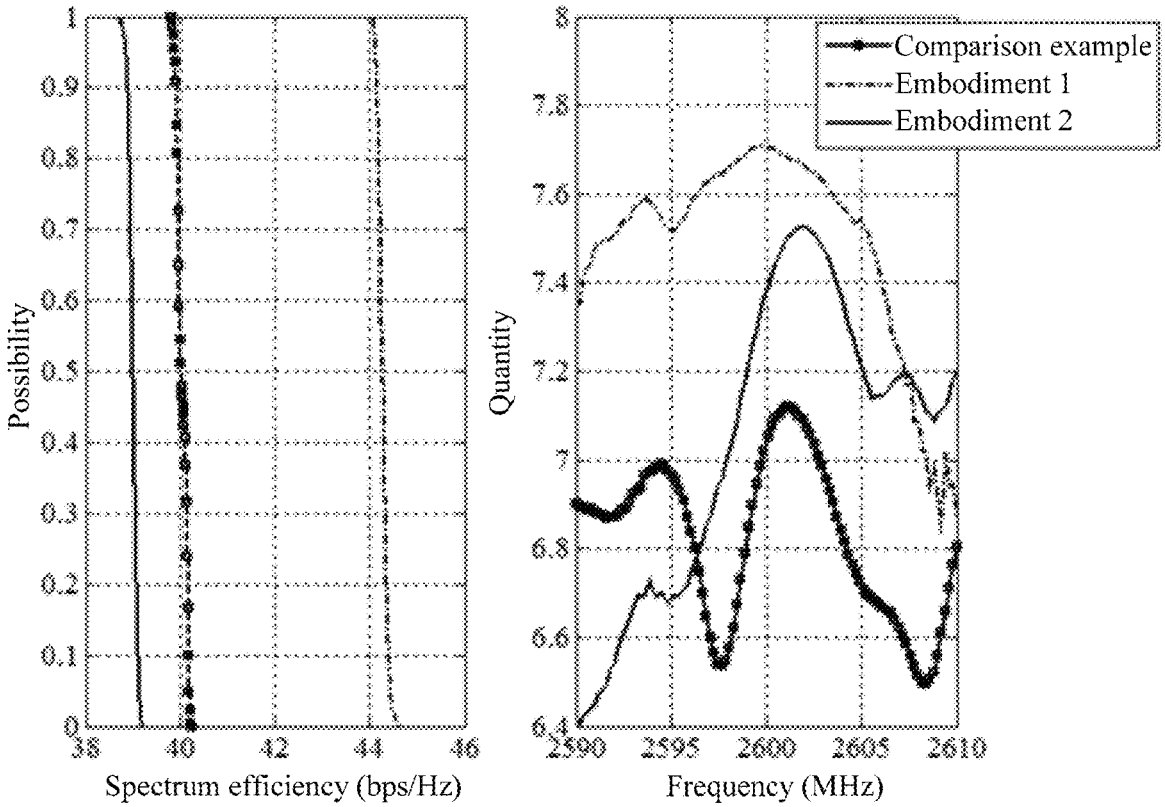
FIG. 30 is a curve comparison diagram of spectrum efficiency of eight-unit MIMO antennas based on FIG. 17, FIG. 23, and the prior art in an actual channel environment according to an embodiment of this application.

Overall performance of the MIMO antennas in Embodiment 1 and Embodiment 2 during actual application is evaluated, and spectrum efficiency of the MIMO antennas is tested by using a MIMO omnidirectional antenna in the prior art as a comparison example. Refer to results shown in FIG. 30.

An existing two-unit MIMO omnidirectional antenna is used as a comparison example. It can be learned from the right figure in FIG. 30 that, in Embodiment 1 provided in the embodiments of this application, in the eight-unit MIMO antenna, when a physical quantity is 8, a maximum actual quantity obtained by means of fitting is 7.6; in Embodiment 2, when a physical quantity is 8, a maximum actual quantity obtained by means of fitting is 7.5; and in the comparison example, an actual quantity obtained by means of fitting is approximately 7. It can be learned that, actual quantities of antenna modules in Embodiment 1 and Embodiment 2 are both higher than an actual quantity of antenna modules in the comparison example, and performance of the eight-unit MIMO antenna provided in the embodiments of this application is relatively excellent. In an existing channel environment, in theory, spectrum efficiency of the two-unit MIMO antenna is approximately 13 bps/Hz. It can be learned by referring to the left figure in FIG. 30, in the experimental example 1 and the experimental example 2, in theory, spectrum efficiency of the eight-unit MIMO antenna is respectively 44 bps/Hz and 39 bps/Hz, and in the comparison example, in theory, spectrum efficiency of the eight-unit MIMO antenna is 40 bps/Hz. It indicates that, the eight-unit MIMO antenna provided in the embodiments of this application have a feature of relatively high spectrum efficiency.

It can be learned from the above that, the size of the antenna module provided in this application is relatively small. When the antenna module is applied to the MIMO antenna, the size of the MIMO antenna can be reduced. When the MIMO antenna is applied to the terminal, the size of the terminal can be reduced, and more antenna modules can be added to the terminal of a particular size, thereby improving the performance of the terminal. Further, the distance between the antenna modules is reduced to further reduce the size of the MIMO antenna. In addition, the overall performance of the foregoing MIMO antenna is systematically tested, and it can be learned that, the MIMO antenna provided in this application has features of low coupling, high isolation, a plurality of bands, and relatively high system spectrum efficiency.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An antenna module, comprising:

a clearance area comprising a first side edge and a second side edge that are adjacent to each other, and a third side edge and a fourth side edge that are disposed respectively opposite to the first side edge and the second side edge;

a support comprises a first side surface and a second side surface that are adjacent to each other, and a third side surface and a fourth side surface that are respectively opposite to the first side surface and the second side surface;

at least two branches, wherein each branch is disposed on the support;

a partial projection of the support on a horizontal plane falls within the clearance area;

a projection on the horizontal plane of one end of each branch that is configured to connect to a feed point is outside the clearance area;

a projection of a tail end on the horizontal plane is inside the clearance area;

a projection of the second side surface of the support on the horizontal plane falls on a straight line of the second side edge of the clearance area and coincides with at least a part of the second side edge of the clearance area;

a distance between a projection of the support on the horizontal plane and each of the third side edge and the fourth side edge of the clearance area is 0 mm to 5 mm; and the first side surface of the support is outside the clearance area.

2. The antenna module of claim 1, wherein:

the at least two branches comprise a first feed branch and a second feed branch, and the antenna module further comprises the feed point and a ground point;

one end of the first feed branch that is configured to connect to the feed point is disposed on the first side surface of the support and extends to the second side surface of the support along the first side surface of the support; and the ground point is connected to the first feed branch on the first side surface of the support;

one end of the second feed branch that is configured to connect to the feed point is connected to the first feed branch on the first side surface of the support and extends to an upper surface of the support along the first side surface of the support; and a length of the first feed branch is ¼ of a wavelength corresponding to a first preset band, and a length of the second feed branch is ⅛ of a wavelength corresponding to a second preset band.

3. The antenna module of claim 2, wherein:

the at least two branches further comprise a parasitic branch;

the parasitic branch is disposed inside the clearance area, and one end of the parasitic branch is connected to the first side edge of the clearance area; and a length of the parasitic branch is 1/10 of a wavelength corresponding to a third preset band.

4. An antenna module, comprising:

a clearance area comprising a first area and a second area that are orthogonal to each other, wherein the first area comprises (1) a side edge-I and a side edge-II that are adjacent to each other, and a side edge-III and a side edge-IV that are disposed respectively opposite to the side edge-I and the side edge-II and the second area is a structure that extends out along a length direction of the side edge-II of the first area;

a support comprising a first side surface and a second side surface that are adjacent to each other, and a third side surface and a fourth side surface that are respectively opposite to the first side surface and the second side surface;

at least two branches, each branch disposed on the support;

a partial projection of the support on a horizontal plane falls within the clearance area;

a projection on the horizontal plane of one end of each branch that is configured to connect to a feed point is outside the clearance area;

a projection of a tail end on the horizontal plane is inside the clearance area;

a projection of the third side surface of the support on the horizontal plane coincides with the side edge-I of the first area;

a projection of the second side surface of the support on the horizontal plane falls on a straight line of the side edge-IV of the first area and coincides with a part of the side edge-IV of the first area;

a distance between a projection of the support on the horizontal plane and each of the side edge-II of the first area and a side edge that is of the second area and that is far away from the first area is 0 mm to 5 mm; and a partial projection of the first side surface of the support on the horizontal plane is outside the clearance area.

5. The antenna module of claim 4, wherein:

the at least two branches comprise a feed branch-I and a feed branch-II, and the antenna module further comprises the feed point and a ground point;

one end of the feed branch-I that is configured to connect to the feed point is connected to the feed point;

a first end of the feed branch-I is disposed on the first side surface of the support and extends to the second side surface of the support along the first side surface of the support; and the ground point is disposed on the feed branch-I on the second side surface of the support;

one end is of the feed branch-II that is configured to connect to the feed point is connected to the feed branch-I on the first side surface of the support and extends to an upper surface of the support along the first side surface of the support; and a length of the feed branch-I is ¼ of a wavelength corresponding to a first preset band, and a length of the feed branch-II is ⅛ of a wavelength corresponding to a second preset band.

6. The antenna module of claim 5, wherein:

the at least two branches further comprise a feed branch-III;

one end of the feed branch-III that is configured to connect to the feed point is connected to the feed branch-II on the first side surface of the support and extends to the fourth side surface of the support along the first side surface of the support; and a length of the feed branch-III is 1/10 of a wavelength corresponding to a third preset band.

7. A multiple-input multiple output (MIMO) antenna, comprising:

a ground plate; and at least two antenna modules disposed on the ground plate, wherein each antenna module comprises:

a clearance area comprising a first side edge and a second side edge that are adjacent to each other, and a third side edge and a fourth side edge that are disposed respectively opposite to the first side edge and the second side edge;

a support comprising a first side surface and a second side surface that are adjacent to each other, and a third side surface and a fourth side surface that are respectively opposite to the first side surface and the second side surface, wherein the first side surface of the support is outside the clearance area;

at least two branches, wherein each branch is disposed on the support;

a partial projection of the support on a horizontal plane falls within the clearance area;

a projection on the horizontal plane of one end of each branch that is configured to connect to a feed point is outside the clearance area;

a projection of a tail end on the horizontal plane is inside the clearance area;

a projection of the second side surface of the support on the horizontal plane falls on a straight line of the second side edge of the clearance area and coincides with at least a part of the second side edge of the clearance area; and a distance between a projection of the support on the horizontal plane and each of the third side edge and the fourth side edge of the clearance area is 0 mm to 5 mm.

8. The MIMO antenna of claim 7, wherein:

the at least two antenna modules comprise a first antenna module and a second antenna module, and the first antenna module is adjacent to the second antenna module; and if the first antenna module and the second antenna module have a same structure, the first antenna module and the second antenna module are sequentially arranged in a staggered manner in a first direction and a second direction, a second side surface of the first antenna module faces a third direction opposite to the first direction, a second side surface of the second antenna module faces the second direction, and a distance between feed points of the two adjacent antenna modules is greater than or equal to ¼ of a wavelength corresponding to a lowest band covered by the antenna module;

if the first antenna module and the second antenna module are mirror symmetric, the first antenna module and the second antenna module are sequentially arranged in a staggered manner in a first direction and a second direction, a second side surface of the first antenna module faces a third direction opposite to the first direction, a second side surface of the second antenna module faces the second direction, and a distance between feed points of the two adjacent antenna modules is greater than or equal to ¼ of a wavelength corresponding to a lowest band covered by the antenna module;

if the first antenna module and the second antenna module are mirror symmetric and have reverse feed directions, a distance between feed points of the two adjacent antenna modules is greater than or equal to ⅛ of a wavelength corresponding to a lowest band covered by the antenna module;

if the first antenna module and the second antenna module are mirror symmetric and have opposite feed directions, a distance between feed points of the two adjacent antenna modules is greater than or equal to ¼ of a wavelength corresponding to a lowest band covered by the antenna module; or if the first antenna module and the second antenna module are mirror symmetric and have a same feed direction, and the fourth side surfaces of the two adjacent antenna modules are disposed opposite to each other, a distance between feed points of the two adjacent antenna modules is greater than or equal to ¼ of a wavelength corresponding to a lowest band covered by the antenna module.

9. The MIMO antenna of claim 8, wherein the at least two antenna modules includes two to eight antenna modules.

10. The MIMO antenna of claim 9, wherein:

the at least two antenna modules comprise eight antenna modules, the eight antenna modules are sequentially arranged to enclose a first enclosed area, and a second side surface of each antenna module faces the exterior of the first enclosed area.

11. The multiple-input multiple output (MIMO) antenna, comprising:

a ground plate; and at least two antenna modules disposed on the ground plate, wherein each antenna module comprising:

a clearance area comprises a first area and a second area that are orthogonal to each other, wherein the first area comprises a side edge-I and a side edge-II that are adjacent to each other, and a side edge-III and a side edge-IV that are disposed respectively opposite to the side edge-I and the side edge-II and the second area is a structure that extends out along a length direction of the side edge-II of the first area;

a support comprises a first side surface and a second side surface that are adjacent to each other, and a third side surface and a fourth side surface that are respectively opposite to the first side surface and the second side surface;

at least two branches, wherein each branch is disposed on the support;

a partial projection of the support on a horizontal plane falls within the clearance area;

a projection on the horizontal plane of one end of each branch that is configured to connect to a feed point is outside the clearance area;

a projection of a tail end on the horizontal plane is inside the clearance area;

a projection of the third side surface of the support on the horizontal plane coincides with the side edge-I of the first area;

a projection of the second side surface of the support on the horizontal plane falls on a straight line of the side edge-IV of the first area and coincides with a part of the side edge-IV of the first area;

a distance between a projection of the support on the horizontal plane and each of the side edge-II of the first area and a side edge that is of the second area and that is far away from the first area is 0 mm to 5 mm; and a partial projection of the first side surface of the support on the horizontal plane is outside the clearance area.

12. The MIMO antenna of claim 11, wherein:

the at least two antenna modules comprise a third antenna module and a fourth antenna module, and the third antenna module is adjacent to the fourth antenna module; and if the third antenna module and the fourth antenna module have a same structure and are disposed orthogonal to each other, the third antenna module and the fourth antenna module are sequentially arranged along a fourth direction opposite to a second direction, and a first side surface of the third antenna module is opposite to a fourth side surface of the fourth antenna module, then a distance between feed points of the two adjacent antenna modules is greater than or equal to ⅛ of a wavelength corresponding to a lowest band covered by the antenna module;

if the third antenna module and the fourth antenna module have a same structure and are sequentially arranged along a first direction perpendicular to a fourth direction, and a fourth side surface of the third antenna module is opposite to a first side surface or a second side surface of the fourth antenna module, a distance between feed points of the two adjacent antenna modules is greater than or equal to ¼ of a wavelength corresponding to a lowest band covered by the antenna module;

if the third antenna module and the fourth antenna module have a same structure and have reverse feed directions and are sequentially arranged along a fourth direction, a distance between feed points of the two adjacent antenna modules is greater than or equal to ¼ of a wavelength corresponding to a lowest band covered by the antenna module;

if the third antenna module and the fourth antenna module are mirror symmetric, are disposed orthogonal to each other and are sequentially arranged along a fourth direction, and a second side surface of the third antenna module is opposite to a first side surface of the fourth antenna module, a distance between feed points of the two adjacent antenna modules is greater than or equal to ⅛ of a wavelength corresponding to a lowest band covered by the antenna module; or if the third antenna module and the fourth antenna module are mirror symmetric and are sequentially arranged along a first direction, and a fourth side surface of the third antenna module is opposite to a third side surface or a fourth side surface of the fourth antenna module, a distance between feed points of the two adjacent antenna modules is greater than or equal to ¼ of a wavelength corresponding to a lowest band covered by the antenna module.

13. The MIMO antenna of claim 12, wherein the at least two antenna modules comprise two to eight antenna modules.

14. The MIMO antenna of claim 13, wherein:

the at least two antenna modules comprise eight antenna modules; and the eight antenna modules are sequentially arranged to enclose a second enclosed area and a second side surface or a third side surface of each antenna module faces the exterior of the second enclosed area.

15. A terminal, comprising:

a multiple-input multiple output (MIMO) antenna; and a radio frequency end disposed on a printed circuit board, wherein each feed point of the MIMO antenna is connected to the radio frequency end, and wherein the radio frequency end is configured to send a signal to the MIMO antenna or receive a signal sent by the MIMO antenna;

wherein the MIMO antenna comprises:

a ground plate;

at least two antenna modules disposed on the ground plate, wherein each antenna module comprises:

a clearance area comprising a first side edge and a second side edge that are adjacent to each other, and a third side edge and a fourth side edge that are disposed respectively opposite to the first side edge and the second side edge;

a support comprising a first side surface and a second side surface that are adjacent to each other, and a third side surface and a fourth side surface that are respectively opposite to the first side surface and the second side surface, wherein the first side surface of the support is outside the clearance area;

at least two branches, wherein each branch is disposed on the support;

a partial projection of the support on a horizontal plane falls within the clearance area;

a projection on the horizontal plane of one end of each branch that is configured to connect to a feed point is outside the clearance area;

a projection of a tail end on the horizontal plane is inside the clearance area;

a projection of the second side surface of the support on the horizontal plane falls on a straight line of the second side edge of the clearance area and coincides with at least a part of the second side edge of the clearance area; and a distance between a projection of the support on the horizontal plane and each of the third side edge and the fourth side edge of the clearance area is 0 mm to 5 mm.

* * * * *